US007498110B2

(12) United States Patent
Taniguchi et al.

(10) Patent No.: US 7,498,110 B2
(45) Date of Patent: Mar. 3, 2009

(54) ELECTROPHOTOGRAPHIC PHOTOSENSITIVE MEMBER

(75) Inventors: Takahisa Taniguchi, Mishima (JP); Kazuyoshi Akiyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 560 days.

(21) Appl. No.: 11/157,990

(22) Filed: Jun. 22, 2005

(65) Prior Publication Data

US 2005/0238976 A1 Oct. 27, 2005

Related U.S. Application Data

(63) Continuation of application No. PCT/JP2005/005072, filed on Mar. 15, 2005.

(30) Foreign Application Priority Data

Mar. 16, 2004 (JP) ..... 2004-074414
Feb. 25, 2005 (JP) ..... 2005-051085

(51) Int. Cl.
*G03G 5/14* (2006.01)

(52) U.S. Cl. ..... 430/67; 430/66

(58) Field of Classification Search ..... 430/66, 430/67

See application file for complete search history.

(56) References Cited

U.S. PATENT DOCUMENTS

| | | | | |
|---|---|---|---|---|
| 4,675,265 | A | 6/1987 | Kazama et al. | 430/67 |
| 4,798,776 | A | 1/1989 | Honda et al. | 430/39 |
| 5,075,187 | A * | 12/1991 | Karakida et al. | 430/57.4 |
| 5,082,756 | A * | 1/1992 | Doi | 430/67 |
| 5,162,182 | A | 11/1992 | Maruta | |
| 5,262,263 | A | 11/1993 | Ohkawa et al. | 430/66 |
| 5,455,138 | A | 10/1995 | Okamura et al. | 430/128 |
| 5,455,438 | A | 10/1995 | Hashimoto et al. | 257/391 |
| 5,582,944 | A | 12/1996 | Yamamura et al. | 430/66 |
| 5,817,181 | A | 10/1998 | Okamura et al. | 134/1.1 |
| 2005/0238976 | A1 | 10/2005 | Taniguchi et al. | 430/66 |

FOREIGN PATENT DOCUMENTS

| | | |
|---|---|---|
| JP | 57-115551 | 7/1982 |
| JP | 61-29851 | 2/1986 |
| JP | 61-219961 | 9/1986 |
| JP | 62-87967 | 4/1987 |
| JP | 62-89063 | 4/1987 |
| JP | 63-35026 | 2/1988 |
| JP | 1-179165 | 7/1989 |
| JP | 2-6961 | 1/1990 |
| JP | 2-203350 | 8/1990 |
| JP | 6-242624 | 9/1994 |
| JP | 2674302 | 7/1997 |
| JP | 2000-258938 | 9/2000 |
| JP | 2003-29437 | 1/2003 |
| JP | 2003-285466 | 10/2003 |

OTHER PUBLICATIONS

Japanese Patent Office machine-assisted translation of Japanese Patent 2003-029437 (pub. Jan. 29, 2003).*

* cited by examiner

*Primary Examiner*—Janis L Dote
(74) *Attorney, Agent, or Firm*—Fitzpatrick, Cella, Harper & Scinto

(57) ABSTRACT

There is provided an electrophotographic photosensitive member used in an electrophotographic apparatus which meets energy saving and higher image quality. The electrophotographic photosensitive member has excellent potential properties, and can suppress the image quality degradation caused by interference. The electrophotographic photosensitive member of the present invention including on a conductive substrate at least a photoconductive layer mainly composed of amorphous silicon, a surface layer, and at least one intermediate layer interposed between the photoconductive layer and the surface layer, wherein the surface layer contains a metal fluoride (exclusive of silicon fluoride) and the intermediate layer contains a metal oxide.

7 Claims, 4 Drawing Sheets

ELECTROPHOTOGRAPHIC PHOTOSENSITIVE MEMBER

This application is a continuation of International Application No. PCT/JP2005/005072, filed on Mar. 15, 2005, which claims the benefit of Japanese Patent Application Nos. 2004-074414 filed on Mar. 16, 2004, and 2005-051085 filed on Feb. 25, 2005.

BACKGROUND OF THE INVENTION

1. Field of the Invention

The present invention relates to an electrophotographic photosensitive member in which image exposure is conducted by use of laser light, in particular, an electrophotographic photosensitive member having excellent electric potential properties and excellent image quality when used in an electrophotographic apparatus which meets energy saving and a higher image resolution, and can also suppress nonuniformity and variation in sensitivity due to interference and further image defect caused by visualization of interference pattern.

2. Related Background Art

As a material for high-performance, high-durability and pollution-free electrophotographic photosensitive members used for copying machines and laser beam printers, amorphous silicon (hereinafter referred to as "a-Si") deposited films compensated with hydrogen and/or a halogen element have hitherto been used. An electrophotographic photosensitive member using an a-Si deposited film has a structure which has a charge injection blocking layer having function to block charge injection from a conductive substrate, a photoconductive layer having photoconductivity, furthermore a surface layer having purposes of imparting capability for blocking charge injection, stable photosensitivity and the like, and other layers. Of these layers, the surface layer governs the electric and optical properties, properties relevant to the use environment and durability of the electrophotographic photosensitive member, and accordingly, surface layers containing various constituent elements and having various compositions have hitherto been proposed.

For example, Japanese Patent Application Laid-Open No. S57-115551 discloses an example of a photoconductive member provided with a non-photoconductive surface layer arranged on a photoconductive layer, wherein the photoconductive layer is constituted of an amorphous silicon material which is mainly composed of silicon and contains at least one of hydrogen atoms and halogen atoms, and the non-photoconductive surface layer is constituted of an amorphous material (a-SiC:H) which is mainly composed of silicon atoms and carbon atoms and also contains hydrogen atoms. Provision of the surface layer constituted of a-SiC:H makes it possible to improve the mechanical strength of the electrophotographic photosensitive member. However, when an a-SiC:H film is used as the surface layer, low-resistant substances such as moisture are adsorbed on the film in a high-humidity environment to tend to decrease the surface resistance and the charge retention ability, and consequently the electrostatic latent image pattern collapses to cause image defects such as image blurring and image deletion, so that sometimes a countermeasure against such resistance decrease of the surface layer is adopted in which the electrophotographic photosensitive member is heated. However, from the viewpoint of energy saving, it is demanded to unnecessitate such a heater. Accordingly, surface layers requiring no such a heater come to be proposed. For example, Japanese Patent Application Laid-Open No. S61-219961 (corresponding to U.S. Pat. No. 4,675,265) discloses an example of an electrophotographic photosensitive member in which a surface layer formed of an amorphous carbon (a-C:H) containing 10 to 40 atom % of hydrogen atoms is provided on a photoconductive layer formed of an amorphous silicon material. Because the surface energy of the a-C:H is small, the low-resistant substances are adsorbed in decreased amounts, so that the decrease of the surface resistance and the degradation of the charge retention ability can be suppressed in a high-humidity environment, resulting in that a heater to heat the electrophotographic photosensitive member tends to become unnecessary. However, an a-C:H film tends to absorb image exposure light, resulting in decrease of the sensitivity thereof. Additionally, while the electrophotographic photosensitive member is used repeatedly, an nonuniform abrasion thickness of the a-C:H film, if any, causes the sensitivity nonuniformity, which sometimes leads to the image density nonuniformity to degrade the image quality. As a surface material capable of overcoming such a drawback, Japanese Patent Application Laid-Open No. 2003-029437 discloses an example of an electrophotographic photosensitive member provided with a surface layer constituted mainly of magnesium fluoride. Magnesium fluoride has a low surface energy, and hence, the surface resistance and the charge retention ability are hardly degraded. Additionally, magnesium fluoride scarcely absorbs light, which makes it possible to suppress the sensitivity degradation.

In an electrophotographic photosensitive member having such a surface layer as described above, an intermediate layer is sometimes interposed between the surface layer and the photoconductive layer for the purpose of improving the degree of close contact, the electric potential properties, the image quality and the like.

For example, Japanese Patent Application Laid-Open No. 63-035026 discloses an electrophotographic photosensitive member having an a-Si intermediate layer containing, as constituent components, carbon atoms and hydrogen atoms and/or fluorine atoms. This intermediate layer makes it possible to reduce the cracking and exfoliation of the photoconductive layer. Additionally, Japanese Patent Application Laid-Open No. H2-203350 (corresponding to U.S. Pat. No. 5,262,263) discloses a technique in which the intermediate layer and the surface layer are formed of a-SiC:H and the surface electric potential is improved by appropriately regulating the carbon content in the interface between the photoconductive layer and the intermediate layer and the carbon content in the interface between the intermediate layer and the surface layer, and by reducing the dark decay.

The intermediate layer can be made to have an effect of improving the image quality. When an image is output by use of an electrophotographic photosensitive member in which such a surface layer as described above is deposited on the photoconductive layer, interference may be generated, when forming an electrostatic latent image by image exposure, to degrade the image quality; this problem can be overcome by providing the intermediate layer. For example, Japanese Patent Application Laid-Open No. H6-242624 (corresponding to U.S. Pat. No. 5,455,438) discloses an example of technique in which interference is prevented by avoiding formation of definite reflection planes, when forming the photoconductive layer and the surface layer by plasma CVD, by virtue of continuously varying the composition on going from the photoconductive layer to the surface layer. Additionally, Japanese Patent No. 2674302 (corresponding to U.S. Pat. No. 5,162,182) discloses an example of an electrophotographic photosensitive member having a charge transport layer, a charge generation layer and a surface layer laminated on a conductive substrate, wherein an interference-controlling layer is provided between the charge generation layer and the surface layer, the interference-controlling layer having a refractive index close to the geometric mean of the refractive indices of the charge generation layer and the surface layer and having a thickness so as to give an optical phase difference close to $\pi/2$ or $3\pi/2$. Owing to these techniques, the manifestation of the interference can be suppressed, and accordingly image quality degradation can be prevented which is caused by manifest interference patters to be transcribed on the image.

Nowadays, in addition to improvement of image qualities such as image density nonuniformity and stability, the demand for higher image resolution has been increasing, and electrophotographic photosensitive members meeting the demand are desired.

For the purpose of enhancing the image resolution, it is effective to reduce the spot diameter of the exposure laser light. Examples of the methods for reducing the spot diameter of the exposure laser light possibly include the improvement of an optical system precision to irradiate the exposure laser light to the photoconductive layer, and the increase of the aperture ratio of the imaging lens. However, the spot diameter cannot be reduced beyond the diffraction limit determined by the wavelength of the exposure laser light and the aperture ratio of the imaging lens, and the requirements for the size increase of the lens and the mechanical precision improvement inevitably involve the increases of the apparatus size and the cost.

Accordingly, in these years, attention has been attracted to a technique in which the wavelength of the exposure laser light is made shorter to reduce the spot diameter so that the resolution of the electrostatic latent image may be enhanced. This is based on the fact that the lower limit of the spot diameter of the laser light is directly proportional to the wavelength of the laser light. In conventional electrophotographic apparatuses, laser light having oscillation wavelengths from 600 to 800 nm is generally used for image exposure, and further reduction of the wavelength can enhance the image resolution. In these years, development of semiconductor lasers having shorter oscillation wavelengths has rapidly progressed in such a way that semiconductor lasers having oscillation wavelengths in the vicinity of 400 nm have come into practical use.

For the purpose of enhancing the image resolution by means of the above described techniques, further improvement is required for the surface layer materials. For example, when the resolution is enhanced by reducing the spot diameter of the exposure laser light, there is a fear that even-such image deletion as nonconspicuous with a conventional spot diameter around 60 to 100 μm is sometimes manifested with an improved image resolution. Accordingly, for the purpose of improving the image resolution, it is necessary to form the surface layer by use of a material hardly causing image deletion.

Additionally, when an electrostatic latent image is formed by use of an exposure laser light having shorter oscillation wavelengths than the conventional oscillation wavelengths, the use of an electrophotographic photosensitive member having the surface layer formed of an a-SiC:H film or an a-C:H film makes larger the exposure laser light absorption in the surface layer to remarkably degrade the sensitivity of the electrophotographic photosensitive member. On the contrary, a magnesium fluoride film has a sufficiently small absorption to such a recently developed exposure laser light of a wavelength in the vicinity of 400 nm, and hence the sensitivity is hardly degraded. Magnesium fluoride is small in surface energy, and accordingly hardly causes image deletion in a high-humidity environment. Consequently, magnesium fluoride is promising as a surface layer material which can simultaneously meet both energy saving and higher image resolution.

Some problems to be overcome still remain in use of magnesium fluoride film for the surface layer. The present inventors have investigated the electrophotographic photosensitive member having a surface layer formed of magnesium fluoride, and have found that when magnesium fluoride is used for the surface layer on an amorphous silicon layer, desirable electric potential properties, particularly such as desirable charging ability, sensitivity and residual electric potential are sometimes hardly obtained. In addition, although metal fluorides such as magnesium fluoride hardly generate image deletion ascribable to the high-humidity environment, image defect accompanying image deletion sometimes tends to occur.

Moreover, when a magnesium fluoride film is used for the surface layer, the interference is manifested between the exposure laser light component which is reflected on the interface between the surface layer and the photoconductive layer and reaches the uppermost surface of the surface layer and the exposure laser light component which is reflected on the uppermost surface of the surface layer, and consequently sometimes the image quality is degraded. More specifically, a photoconductive layer composed mainly of amorphous silicon is often formed by the glow discharge method, in particular, the plasma CVD method using the electric power supply frequency of the RF band, VHF band or μW band because these methods are easy to control the operation conditions and capable of yielding excellent film properties. However, many of metal fluorides such as magnesium fluoride can hardly undergo film formation by the plasma CVD method, and accordingly, it is appropriate that a photoconductive layer is formed by means of a plasma CVD apparatus, and then a surface layer formed of a magnesium fluoride film is formed by use of a sputtering apparatus, a deposition apparatus or the like. The a-SiC:H film and the a-C:H film which have hitherto been used for the surface layer can be relatively easily formed by the CVD method, and the composition proportions of the elements constituting the layers can be continuously varied on going from the photoconductive layer to the surface layer to avoid formation of a definite reflection plane and to thereby prevent the interference; however, when a magnesium fluoride film is formed by sputtering or the like after an amorphous silicon film has been formed by the plasma CVD method, a reflection plane tends to be formed between the photoconductive layer and the surface layer. Consequently, interference tends to degrade the image quality when the exposure laser light tends to be reflected between the photoconductive layer and the surface layer because of the small roughness of the photoconductive layer surface and the like reasons. In order to overcome this drawback, an intermediate layer to suppress interference may be provided between the photoconductive layer and the magnesium fluoride film; however, in this case, it is necessary to appropriately select a material which can simultaneously ensure both the excellent electric potential properties and the suppression of the image quality degradation caused by interference.

SUMMARY OF THE INVENTION

The present invention has been achieved for the purpose of improving the above described problems. An object of the present invention is to provide an electrophotographic photosensitive member having excellent electric potential properties and being capable of suppressing the image quality degradation caused by interference when used in an electrophotographic apparatus which meets energy saving and image quality improvement.

For the purpose of achieving the above described object, the present invention provides an electrophotographic photosensitive member has been constituted as follows. The electrophotographic photosensitive member has at least an photoconductive layer composed mainly of amorphous silicon and a surface layer formed on a conductive substrate, and at least one intermediate layer provided between the photoconductive layer and the surface layer, wherein the surface layer comprises a metal fluoride (exclusive of silicon fluoride) and the intermediate layer comprises a metal oxide.

As will be described below, in the present invention, by using a metal fluoride in the surface layer of the electrophotographic photosensitive member, and moreover, by providing at least one intermediate layer composed of a metal oxide between the photoconductive layer and the surface layer, there can be obtained an electrophotographic photosensitive member which is excellent in charging ability, sensitivity and electric potential properties such as residual electric potential even in an electrophotographic apparatus which does not use a heater for heating the electrophotographic photosensitive member so as to meet energy saving.

DESCRIPTION OF THE PREFERRED EMBODIMENTS

The embodiments and effects of the present invention will be described below with reference to the accompanying drawings.

Figure 1A:
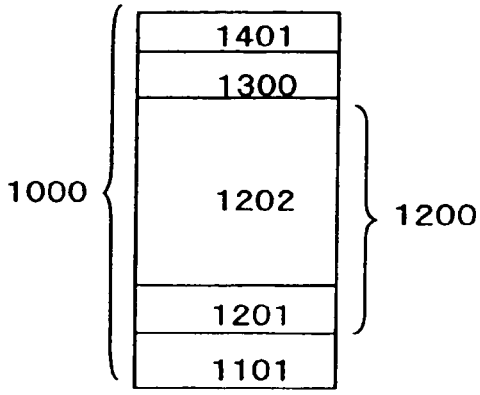
FIG. 1A is a schematic diagram showing an example of the layer structure of an electrophotographic photosensitive member involved in the present invention.

FIG. 1A shows an example of the layer structure of an electrophotographic photosensitive member involved in the present invention. The amorphous silicon electrophotographic photosensitive member 1000 shown in FIG. 1A includes an eletroconductive substrate 1101 made of aluminum or the like, and the following layers successively laminated on the surface of the conductive substrate 1101, namely, an amorphous silicon layer 1200 composed of a charge injection blocking layer 1201, a photoconductive layer 1202 and the like; an intermediate layer 1300; and a surface layer 1401.

The charge injection blocking layer 1201 has a function to block the charge injection from the conductive substrate 1101 to the photoconductive layer 1202 and may be formed according to need. Additionally, the photoconductive layer 1202 is constituted of a non-single-crystal material containing silicon atoms, and has photoconductivity. The surface layer 1401 has function to block the charge injection from the surface of the electrophotographic photosensitive member 1000 to the photoconductive layer 1202 and/or functions to protect the surface of the photoconductive layer 1202 and simultaneously to impart moisture resistance, properties relevant to repeated use, electric voltage resistance, properties relevant to the use environment and durability. The intermediate layer 1300 composed of at least one layer is provided between the photoconductive layer 1202 and the surface layer 1401. The intermediate layer 1300 may be composed of one layer as shown in FIG. 1A, but may also be composed of two or more layers (see FIG. 1B) as long as the absorption of the incident laser light does not become large.

In the present invention, a metal fluoride (exclusive of silicon fluoride) is used for the surface layer 1401. It is to be noted that even if fluorine is contained in the surface layer 1401, when silicon is the main component of the surface layer, low-resistant substances sometimes tend to be adsorbed onto the surface layer in a high-humidity environment, and sometimes light absorption is increased. Consequently, for the purpose of obtaining an electrophotographic photosensitive member simultaneously meeting energy saving and high image quality, it is necessary to use a metal fluoride (exclusive of silicon fluoride) for the surface layer 1401. Examples of the metal fluoride (exclusive of silicon fluoride) to be used for the surface layer 1401 include magnesium fluoride ($MgF_2$), lanthanum fluoride ($LaF_3$), barium fluoride ($BaF_2$), calcium fluoride ($CaF_2$) and aluminum fluoride ($AlF_3$). These metal fluorides are small in surface energy, so that by using these metal fluorides for the surface layer 1401, there can be obtained an electrophotographic photosensitive member in which image deletion to be caused by high-humidity environment is hardly generated. Of the above described metal fluorides, magnesium fluoride and lanthanum fluoride are preferable because these metal fluorides are particularly small in light absorption and have a hardness suitable for the surface layer.

The present inventors investigated from various viewpoints the electrophotographic photosensitive member which uses magnesium fluoride for the surface layer 1401, and consequently it was found that when a metal fluoride was formed as the surface layer 1401 on the photoconductive layer 1202, sometimes excellent electric potential properties, particularly desired properties as to charging ability, sensitivity and residual electric potential were hardly obtained. Also when an a-SiC:H layer was provided as the intermediate layer 1300, sometimes sufficient charging ability and desired residual electric potential were hardly obtained. Moreover, when a metal fluoride is formed as the surface layer 1401 on the photoconductive layer 1202, and when an a-SiC:H film was provided as the intermediate layer 1300, sometimes image deletion was manifested and image defect tended to be generated. The generation of the image deletion was particularly remarkable when the spot diameter of the exposure laser light was made small. The detailed causes for these problems are not clear, but it is inferred that fluorine gas may degrade the film properties of the photoconductive layer 1202 and the intermediate layer 1300 formed of a-SiC:H. More specifically, the metal fluoride is often formed by sputtering through the reaction between the metal atoms and fluorine atoms, and hence it is inferred that the film properties such as electric properties are degraded in such a way that when the photoconductive layer 1202 and the intermediate layer 1300 formed of a-SiC:H are exposed to fluorine, fluorine atoms are taken into the films, highly reactive fluorine helps the films take impurities thereinto, and fluorine affects adversely the bonds between the atoms in the films. It is also inferred that when the photoconductive layer 1202 and the intermediate layer 1300 formed of a-SiC:H are exposed to fluorine, the interface with the surface layer 1401 formed of magnesium fluoride is modified, and consequently the charges come to easily drift in the interface and the image deletion thereby tends to be manifested.

The present inventors have found that metal oxides are most appropriate for the intermediate layer material, as a result of searching for the most appropriate intermediate layer material such that when a magnesium fluoride film is used as the surface layer 1401 of the electrophotographic photosensitive member 1000, excellent electric potential properties, particularly such as desired charging ability, sensitivity and residual electric potential can be ensured, and the image deletion is hardly manifested even for enhanced resolution. It is interpreted that the fact that provision of an intermediate layer 1300 formed of a metal oxide ensures the desired electric potential properties may be ascribable to the film properties such as the electric properties that hardly vary even when the metal oxide is exposed to fluorine. Additionally, metal oxides are small in light absorption to be able to prevent the sensitivity degradation. Examples of the metal oxides to be used for the intermediate layer 1300 include aluminum oxide ($Al_2O_3$), magnesium oxide (MgO), lanthanum oxide ($La_2O_3$), titanium oxide ($TiO_2$), zirconium oxide ($ZrO_2$) and silicon oxides (SiO, $SiO_2$). It is to be noted that these metal fluorides and metal oxides need not be of the stoichiometric compositions; these metal fluorides may contain oxygen, hydrogen, carbon, nitrogen and the like, and these metal oxides may contain hydrogen, fluorine, carbon, nitrogen and the like; however, for the purpose of obtaining a film small in light absorption, it is preferable that the contents of these impurities are small.

As described above, use of a metal fluoride (exclusive of silicon fluoride) for the surface layer 1401 and use of a metal oxide for the intermediate layer 1300 make it possible to suppress the image deletion caused by high-humidity environment and to obtain an electrophotographic photosensitive member excellent in electric potential properties. Additionally, the use of these metal fluoride and oxide makes it possible to prevent the deterioration of the amorphous silicon layer 1200, and can thereby suppress the manifestation of the image deletion even when the resolution is enhanced.

Accordingly, in the present invention, when exposure is conducted with a spot laser light on the photoconductive layer 1202, the image resolution can be enhanced by making the spot diameter equal to or smaller than 40 μm. In the present invention, by use of a laser light having an oscillation wavelength of 380 to 450 nm as a method for reducing the spot diameter, the electrostatic latent image can be formed. By carrying out image exposure by use of a laser light having a shorter wavelength than those having hitherto been used, the writing density is improved and the image resolution can be enhanced. The metal fluorides exclusive of silicon fluoride to be used for the surface layer 1401 and the metal oxides to be used for the intermediate layer 1300 are small in light absorption even in wavelengths ranging from 380 to 450 nm, so that the sensitivity is hardly decreased when the electrophotographic photosensitive member concerned is set in an electrophotographic apparatus to meet the higher image resolution. Examples of other methods for reducing the spot diameter of the exposure laser light include the improvement of the precision of the optical system involved, and the enlargement of the aperture ratio of the lens. In general, in a scanning optical system in which the exposure laser light is scanned, scanning is carried out along two directions, namely, the main scanning direction for scanning with a rotary polygonal mirror along the direction of the generating line of the electrophotographic photosensitive member 1000 and the sub-scanning direction based on the rotation of the electrophotographic photosensitive member, and accordingly, the spot has an elliptical shape in which the main scanning spot diameter and the sub-scanning spot diameter are different; however, the spot diameter in the present invention may be any one of these diameters, and accordingly, it is to be defined as the smaller one thereof. This is because the effect of the image deletion is more remarkably manifested along the direction for the smaller spot diameter.

Figure 2:
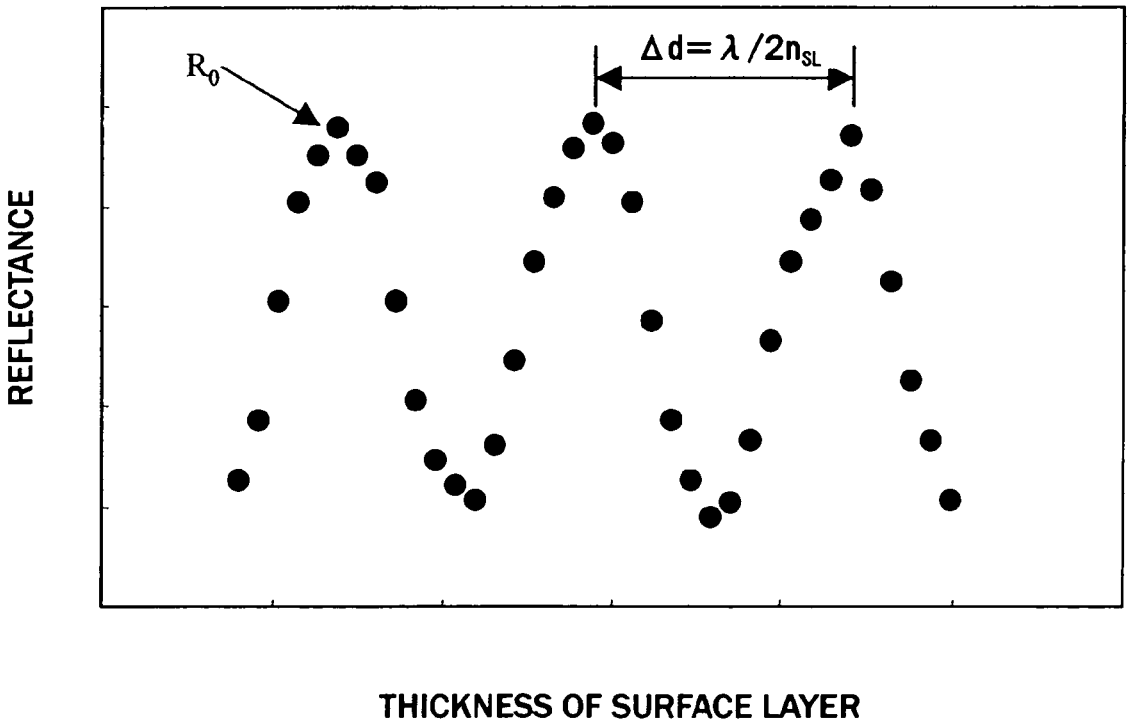
FIG. 2 is a graph showing an example of the relation between the thickness of a surface layer and the reflectance thereof.

Moreover, in the present invention, the reflectance on the surface of the electrophotographic photosensitive member 1000 can be reduced by regulating the thickness and the refractive index of the intermediate layer 1300. Reduction of the reflectance makes it possible to suppress the image quality degradation caused by the sensitivity variation, the sensitivity nonuniformity due to the reflectance nonuniformity along the direction of the generating line, and moreover, by the transcribed interference pattern and the like, all ascribable to the repeated use of the electrophotographic photosensitive member. The reflectance is varied by the various factors in the course of the repeated use of the electrophotographic photosensitive member. Accordingly, for the purpose of suppressing the image quality degradation, it is necessary to reduce the greatest value of the variable reflectance. Description will be made below on the factors causing the reflectance variation in the course of the repeated use of the electrophotographic photosensitive member. A first factor is the thickness variation of the surface layer 1401. FIG. 2 shows an example of the relation between the thickness of the surface layer 1401 and the reflectance thereof. As FIG. 2 shows, the reflectance is varied periodically with a certain variation width. This is ascribable to the variation of the optical thickness of the surface layer 1401 caused by the abrasion of the surface layer 1401; for example, when the incident laser light is made vertically incident on the photoconductive layer, the period of the reflectance variation in relation to the abrasion amount of the surface layer corresponds to the thickness difference of the surface layer 1401 which gives the optical phase difference variation of π radians; the thickness difference value Δd (nm) is represented by the following formula:

$$\Delta d=\lambda/2n_{SL} \tag{5}$$

In formula (5), λ represents the wavelength (nm) of the incident laser light, and $n_{SL}$ represents the refractive index of the surface layer 1401. When the incident laser light is made vertically incident on the photoconductive layer, the incident light component reflected on the interface between the photoconductive layer 1202 and the intermediate layer 1300 to reach the surface layer 1401 and the incident light component reflected on the interface between the intermediate layer 1300 and the surface layer 1401 are destructively superposed or constructively superposed. Additionally, the reflectance is varied with a period of Δd due to abrasion of the surface layer 1401. The greatest value of the maximal values of the reflectance within the width of the variation thereof caused by the abrasion of the surface layer 1401 is to be represented by $R_0$. When $R_0$ becomes large, the light intensity incident on the photoconductive layer 1202 is varied largely in the course of repeated use of the electrophotographic photosensitive member 1000. Consequently, the width of the sensitivity variation caused by abrasion of the surface layer 1401 is made large, and eventually no constant image density can be obtained in the course of repeated use of the photosensitive member. Thus, it is necessary to regulate the thickness and the reflectance of the intermediate layer 1300 so as to reduce the $R_0$ value.

Figure 3:
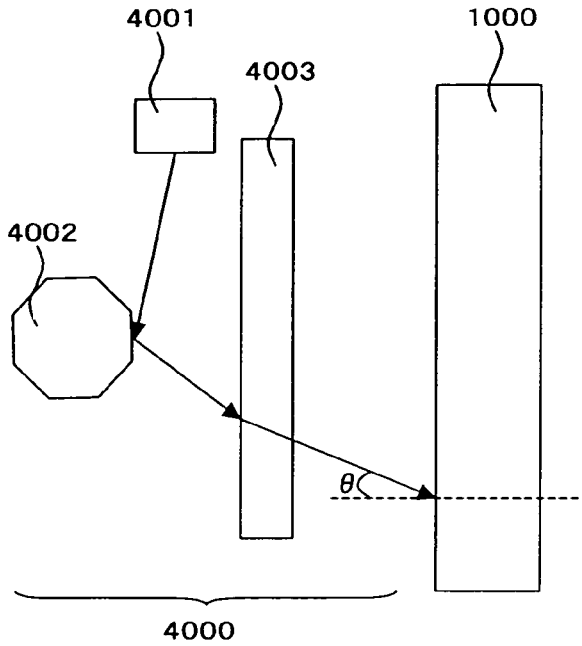
FIG. 3 is a plan view of an example of an exposure device to form an electrostatic latent image on an electrophotographic photosensitive member.
Figure 4:
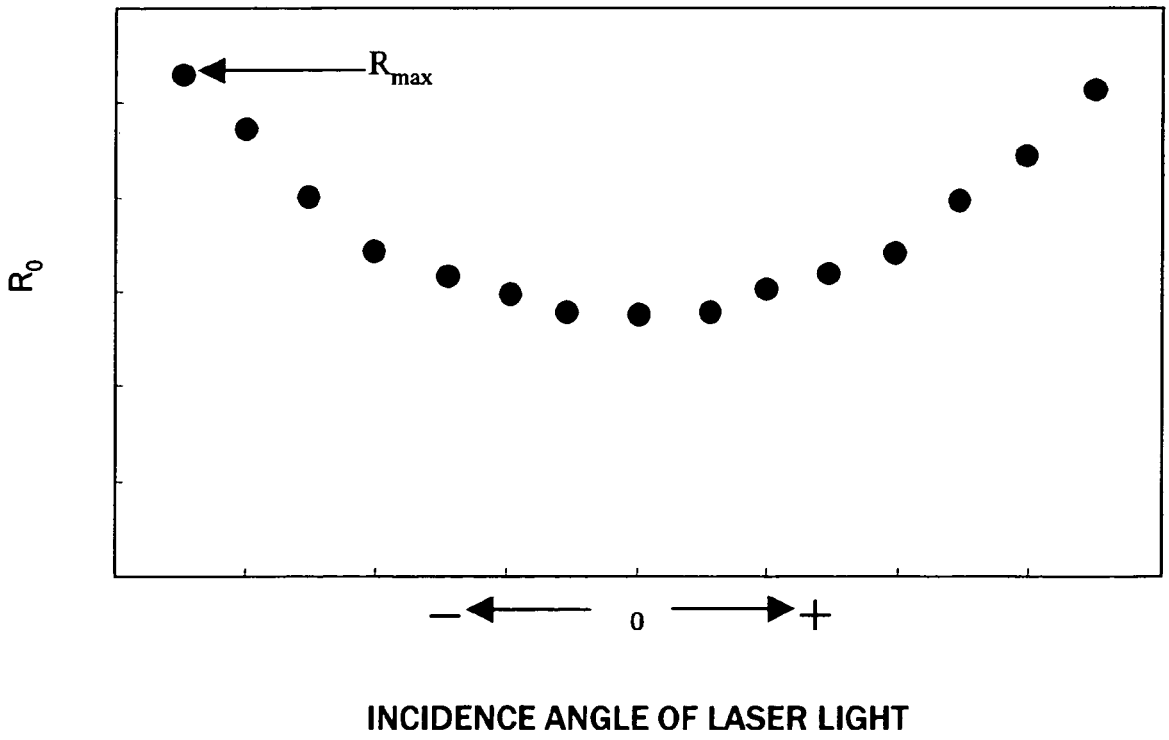
FIG. 4 is a graph showing an example of the relation between the incident angle of laser light and the greatest value of reflectance at the incident position.

A second factor for the reflectance variation is the incidence angle of the laser light. FIG. 3 is a plan view of an example of an exposure device to form an electrostatic latent image on an electrophotographic photosensitive member. In general, an image exposure apparatus is composed of a laser diode 4001, a rotary polygonal mirror 4002, and a lens 4003. The laser beam emitted from the laser diode 4001 is deflected by the rotary polygonal mirror 4002 and is made to scan through the lens 4003 the electrophotographic photosensitive member 1000 charged so as to have a predetermined electric potential, and consequently the electrostatic latent image is formed. When forming an electrostatic latent image, scanning is generally carried out on the electrophotographic photosensitive member in such a way that the laser beam is made incident vertically around the center of the electrophotographic photosensitive member, and according to deviation of the location from the center of the electrophotographic photosensitive member, the incidence angle θ along the main scanning direction is varied within a range of about ±10° to ±20°. When the laser light is made incident on the photoconductive layer 1202 with varying incidence angle in the image exposure, the phase difference between the following two light components is varied as a function of the incidence angle of the laser light: one is the incident laser light component reflected on the interface between the photoconductive layer 1202 and the intermediate layer 1300 to reach the surface layer 1401 and the other is the incident laser light component reflected on the interface between the surface layer 1401 and the intermediate layer 1300. Accordingly, the greatest value $R_0$ of the maximal values within the width of the reflectance variation caused by the abrasion of the surface layer 1401 is varied as a function of the incidence angle. In other words, the $R_0$ value is varied as a function of the location along the direction of the generating line corresponding to the incidence angle; the greatest or maximum value of $R_0$ along the direction of the generating line in this case is denoted by $R_{max}$. FIG. 4 shows an example of the relation between the incidence angle of the laser light and the $R_0$ values. In FIG. 4, the reflectance becomes maximal ($R_{max}$) for the incident angles largest in absolute value, namely, for the portions in the vicinity of each of the end portions of the electrophotographic photosensitive member. When the $R_{max}$ value becomes large, sometimes the reflectance nonuniformity becomes large along the direction of the generating line of the electrophotographic photosensitive member. If the reflectance nonuniformity becomes large, the intensity of the light incident on the photoconductive layer 1202 exhibits .nonuniformity along the direction of the generating line, and this nonuniformity tends to lead to the sensitivity nonuniformity and hence the image density nonuniformity. Additionally, if the $R_{max}$ value becomes large, the interference pattern tends to appear, which is sometimes transcribed on the image to degrade the image quality. Accordingly, it is necessary to regulate the thickness and the reflectance of the intermediate layer 1300 so that the maximum value of the reflectance of the electrophotographic photosensitive member within the image formation range thereof may be maintained at a low level even when the angle of the laser light is varied. The present inventors have found that, when the above described material small in light absorption is used for the intermediate layer 1300 and the surface layer 1401, the greatest value $R_{max}$ for the reflectance is preferably 20% or less for the purpose of effectively suppressing the sensitivity variation caused by the surface abrasion of the surface layer 1401, the sensitivity nonuniformity along the direction of the generating line of the electrophotographic photosensitive member, and the transcription of the interference pattern on the image.

As described above, the sensitivity variation caused by the abrasion of the surface layer 1401, the sensitivity nonuniformity along the direction of the generating line of the electrophotographic photosensitive member and the transcription of the interference pattern on the image can be suppressed by regulating the thickness and the reflectance of the intermediate layer 1300 so that the greatest value of the reflectance, varied as a function of the thickness variation of the surface layer 1401 and the incidence angle of the incident laser light, may be 20% or less when exposure is carried out on the photoconductive layer 1202, by using a light scanning device in which the exposure laser light is made incident on the rotary polygonal mirror 4002 to deflect the laser light and the incidence angle of the exposure laser light is being varied in the course of the scanning.

The refractive index and the thickness of the intermediate layer 1300 can be optionally controlled so that the greatest value of the reflectance may be 20% or less. Among others, an effective method for reducing the greatest value of the reflectance may be cited in which the thickness of the intermediate layer is controlled so that the incident light component reflected on the interface between the photoconductive layer 1202 and the intermediate layer 1300 to reach the interface between the intermediate layer 1300 and the surface layer 1401 and the incident light component reflected on the interface between the intermediate layer 1300 and the surface layer 1401 may be given a phase difference therebetween resulting in a destructive superposition of these components, namely, a phase difference of odd number times of λradians. This is represented by the following formula (1):

$$\Delta\phi=\pi(2k-1) \tag{1}$$

where Δφ denotes the phase difference between the component reflected on the interface between the photoconductive layer 1202 and the intermediate layer 1300 to reach the interface between the intermediate layer 1300 and the surface layer 1401 and the component reflected on the interface between the intermediate layer 1300 and the surface layer 1401, k being a positive integer. By regulating the thickness of the intermediate layer 1300 so as to satisfy formula (1), when the laser light is made normally incident on the photoconductive layer 1202, the phase difference between the following two components can be made to result in a destructive superposition of the two components: one is the component reflected on the interface between the photoconductive layer 1202 and the intermediate layer 1300 to reach the interface between the intermediate layer 1300 and the surface layer 1401, and the other is the component reflected on the interface between the intermediate layer 1300 and the surface layer 1401. In this way, it comes to be possible to reduce, when the laser light is made normally incident, the greatest value $R_0$ of the maximal values of the reflectance within the width of the variation thereof caused by the abrasion of the surface layer 1401. However, for the purpose of reducing $R_{max}$ as the greatest value of the $R_0$ values in the whole image area, it is necessary that the k value in formula (1) be made as small as possible and the thickness of the intermediate layer 1300 be made small. In other words, when image exposure is made while the incidence angle of the exposure laser light is being varied, if the thickness of the intermediate layer 1300 is too large, the variation of the length of the optical path to reach the photoconductive layer 1202 as a function of the variation of the angle becomes large. The variation of the optical path length leads to the phase difference deviation from the conditions of formula (1) for reducing the reflectance, and concomitantly sometimes the $R_{max}$ value is increased to degrade the image quality. Consequently, the k value in formula (1) is preferably made as small as possible; if the k value falls within a range from 1 to 5, it is possible to prevent the effect that the phase difference within the image area deviates drastically from the conditions of formula (1) to increase $R_{max}$. Although the nonuniformity in the thickness of the intermediate layer 1300 is preferably as small as possible, the effect of the thickness nonuniformity on the reflectance nonuniformity can be made small if the thickness nonuniformity falls within a range giving no large variation to the optical phase difference of the intermediate layer 1300. The thickness of the intermediate layer may be constant along the direction of the generating line of the electrophotographic photosensitive member, but alternatively, the thickness of the intermediate layer 1300 may be made to have a distribution along the direction of the generating line so that in the location along the direction of the generating line corresponding to the incidence angles a phase difference may be obtained to lead to destructive superposition between the component reflected on the interface between the photoconductive layer 1202 and the intermediate layer 1300 to reach the interface between the intermediate layer 1300 and the surface layer 1401 and the component reflected on the interface between the intermediate layer 1300 and the surface layer 1401.

The conditions for the thickness of the intermediate layer 1300 to satisfy formula (1) are determined according to the number of the layers constituting the intermediate layer 1300 and the magnitude relation between the reflectance of the photoconductive layer 1202 and the reflectance of the surface layer 1401.

For example, when the intermediate layer 1300 is composed of one layer, by controlling the thickness d (nm) of the intermediate layer 1300 so as to satisfy the following formulas (2) and (3), the phase difference between the incident light component reflected on the interface between the photoconductive layer 1202 and the intermediate layer 1300 and the incident light component reflected on the interface between the intermediate layer 1300 and the surface layer 1401 can be made to be odd number times of π radians:

$$d=(\lambda/4n)\cdot(2m-1) \tag{2}$$

$$n_{SL}<n<n_{PCL} \tag{3}$$

where λ represents the wavelength (nm) of the exposure laser light, n represents the refractive index of the intermediate layer 1300, $n_{SL}$ represents the refractive index of the surface layer 1401, and $n_{PCL}$ represents the refractive index of the photoconductive layer 1202.

As shown in formula (2), by setting the optical thickness of the intermediate layer 1300 at an odd number times a quarter the wavelength of the exposure laser light, the phase difference between the following two components can be made to result in a destructive superposition of the two components when the laser light is made vertically incident on the photoconductive layer 1202: one is the component reflected on the interface between the surface layer 1401 and the intermediate layer 1300 and the other is the component reflected on the interface between the intermediate layer 1300 and the photoconductive layer 1202. In order to obtain a phase difference for the k value in formula (1) to fall within a range from 1 to 5, it is necessary to make the m value in formula (2) fall within a range from 1 to 5. Even under the conditions satisfying formula (2), although the nonuniformity in the thickness of the intermediate layer 1300 is preferably as small as possible, the effect of the thickness nonuniformity on the reflectance nonuniformity can be made small if the thickness nonuniformity falls within a range giving no large variation to the optical phase difference of the intermediate layer 1300. For example, when the optical phase difference of the intermediate layer 1300 falls within a range of ±π/8 radian, namely, the nonuniformity from the thickness in formula (2) falls within a range of about ±λ/16n, the effect of the reflectance nonuniformity caused by the thickness nonuniformity can be sufficiently suppressed. Accordingly, in the present invention, the range of the thickness nonuniformity falling within the range of ±λ/16n from the thickness satisfying formula (1) is also included.

As described above, by regulating the thickness of the intermediate layer 1300 so as to satisfy formula (1), the greatest value $R_{max}$ of the reflectance can be made small; however, in the present invention, the greatest value of the reflectance may be further reduced by providing the intermediate layer 1300 with antireflection capability. More specifically, the $R_{max}$ value can be further reduced with a phase difference between the following two components to result in destructive superposition of the two components, and by equalizing the intensities of the two components: one is the incident laser light component reflected on the interface between the surface layer 1401 and the intermediate layer 1300 and the other is the incident laser light component reflected on the interface between the intermediate layer 1300 and the photoconductive layer 1202 to reach the surface layer 1401. In order to provide the intermediate layer 1300 with antireflection capability, the refractive index of the intermediate layer 1300 is controlled.

For example, when the intermediate layer 1300 is composed of one layer, by controlling the refractive index n of the intermediate layer 1300 so as to satisfy the following formula in addition to formula (2), the intermediate layer 1300 can be provided with antireflection capability:

$$n^2=n_{PCL}\cdot n_{SL} \tag{4}$$

where n, $n_{PCL}$ and $n_{SL}$ represent the refractive indices of the intermediate, photoconductive and surface layers, respectively. By regulating the refractive index of the intermediate layer 1300 so as to satisfy formula (4), the greatest value of reflectance can be further reduced. Although the deviation of the refractive index of the intermediate layer 1300 is preferably made as small as possible, the intermediate layer 1300 can be provided with a sufficient antireflection capability when the deviation falls within a range of about ±0.2 from the refractive index satisfying formula (4), and the greatest value of reflectance can be further reduced. It is to be noted that even when the refractive index of the intermediate layer 1300 is controlled to satisfy formula (4), the m value in formula (2) is preferably made as small as possible, and preferably falls within a range from 1 to 5.

Figure 1B:
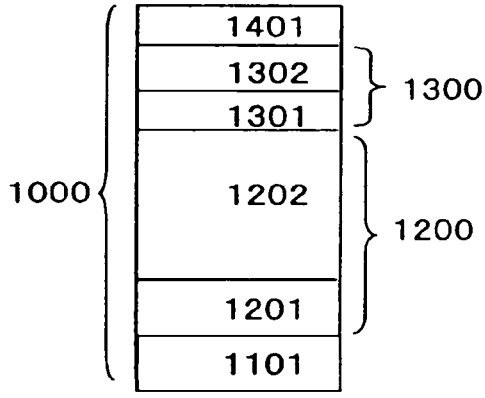
FIG. 1B is a schematic diagram showing an example of the layer structure of an electrophotographic photosensitive member involved in the present invention wherein two intermediate layers are provided.

Although description has been made above on a method for suppressing the reflectance to a low level when the intermediate layer 1300 is composed of one layer, the greatest value of reflectance can be reduced even when the intermediate layer is composed of two or more layers. FIG. 1B shows an example of a case in which the intermediate layer 1300 is composed of two layers. In this case, the intermediate layer 1300 is composed of a first intermediate layer 1301 in contact with the photoconductive layer 1202 and a second intermediate layer 1302 in contact with the surface layer 1401. By regulating the thickness and refractive index of each of the first intermediate layer 1301 and the second intermediate layer 1302, the greatest value of reflectance can be suppressed to be 20% or less. Similarly to the case where the intermediate layer 1300 is composed of one layer, the greatest value of reflectance can be suppressed to a lower level by controlling the thickness of each of the two intermediate layers so as for the phase difference between the following two components to be odd number times of π radians: one is the component reflected on the interface between the surface layer 1401 and the second intermediate layer 1302 and the other is the component reflected on the interface between the first intermediate layer 1301 and the photoconductive layer 1202 to reach the surface layer 1401.

For example, when the intermediate layer 1300 is composed of two layers, the thickness $d_1$ (nm) of the first intermediate layer 1301 in contact with the photoconductive layer and the thickness $d_2$ (nm) of the second intermediate layer 1302 in contact with the surface layer 1401 are controlled. For this case, an example of the thickness conditions for the first intermediate layer 1301 and the second intermediate layer 1302 under which the phase difference between the following two components can be made to be odd number times π radians: one is the incident light component reflected on the interface between the photoconductive layer 1202 and the first intermediate layer 1301 to reach the surface layer 1401 and the other is the incident light component reflected on the interface between the second intermediate layer 1302 and the surface layer 1401:

$$d_1=(\lambda/4n_1)\cdot(2m_1-1) \quad (6)$$

$$d_2=(\lambda/4n_2)\cdot(2m_2-1) \quad (7)$$

$$n_{SL}<n_2<n_1<n_{PCL} \quad (8)$$

where $n_1$ and $n_2$ represent the refractive indices of the first intermediate layer 1301 and the second intermediate layer 1302, respectively, $m_1$ and $m_2$ each representing a positive integer.

Moreover, by regulating the refractive index of each layer of the intermediate layer 1300 so as to provide the intermediate layer 1300 with antireflection capability, the greatest value of reflectance can be further reduced. When the intermediate layer 1300 is composed of two layers, by controlling the refractive indices of the first intermediate layer 1301 and the second intermediate layer 1302 so as to satisfy the following formula, in addition to formulas (6) and (7), the intermediate layer 1300 can be provided with antireflection capability:

$$n_2^2\cdot n_{PCL}=n_1^2\cdot n_{SL} \quad (9)$$

Here, description has been made on a set of conditions under which the greatest value of reflectance can be made small. However, when the intermediate layer is composed of two or more layers, there are a plurality of sets of conditions depending on the magnitude relations between the refractive indices of the respective layers of the intermediate layer 1300, and accordingly, the thickness of each of the layers is appropriately controlled according to the refractive indices of the selected constituents for the layers. It may be noted that even when the intermediate layer 1300 is composed of a plurality of layers, the thickness of each of the intermediate layers is preferably reduced so as for the k value of formula (1) to fall within a range from 1 to 5.

As described above, the reflectance can be suppressed to a low level even when the intermediate layer 1300 is composed of a plurality of layers; however, it is preferable that the intermediate layer is composed of only one layer, because by making the intermediate layer be composed of a plurality of layers, sometimes the production efficiency is decreased, the absorption of the incident laser light becomes large, and the optical design of the thickness control and the like is complicated.

Next, description will be made below on the outline of the production of the electrophotographic photosensitive member involved in the present invention.

Figure 5:
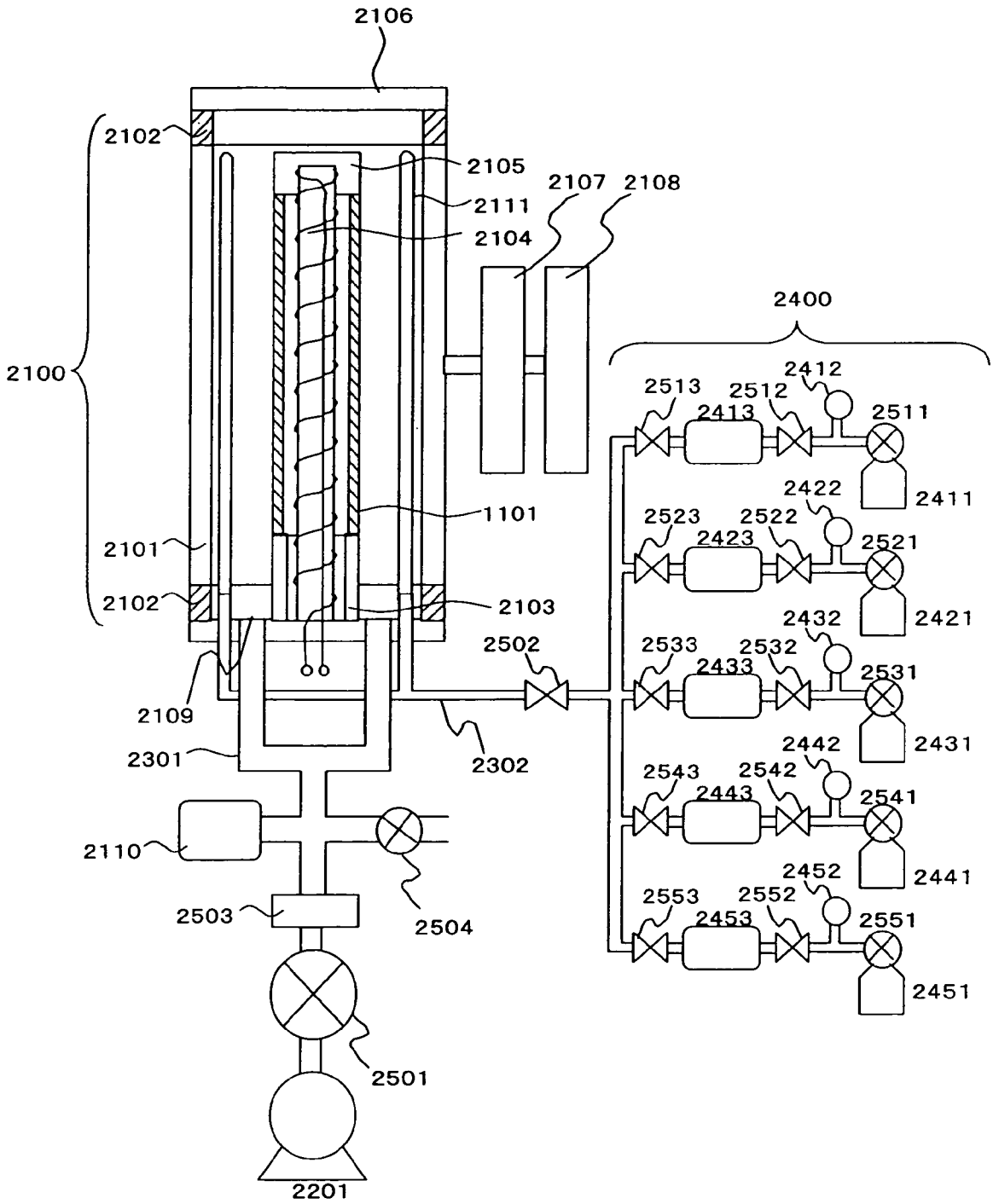
FIG. 5 is a schematic diagram showing an example of a plasma CVD apparatus for forming on a cylindrical substrate a photoconductive thin film composed mainly of amorphous silicon.

First of all, description will be made on an example of the outline of the production of a part composed mainly of amorphous silicon. The part composed mainly of amorphous silicon may be formed by means of deposited film formation methods such as the glow discharge method (the direct current or alternating current CVD method or the like), the sputtering method, the vacuum deposition method, the ion plating method, the photo-assisted CVD method and the thermal CVD method. These deposited film formation methods may be appropriately selected according to the production conditions, the investment load, the production scale, the desired properties and the like; however, the glow discharge method, in particular, the high frequency glow discharge method using the electric power supply frequency falling in the RF band, VHF band, μW band and the like is preferable because this method permits relatively easy control of the conditions for formation of an amorphous silicon layer 1200 having desired properties. FIG. 5 shows an example of an apparatus for forming an amorphous silicon layer 1200 by means of the plasma CVD method. A reaction vessel 2100 is composed of a cathode electrode 2101 doubling as an electrode to input high frequency electric power and ceramic insulators 2102 to insulate the cathode electrode 2101. In the reaction vessel 2100, a substrate holder 2103 is arranged to hold a substrate 1101, and a heater 2104 to heat the substrate 1101 to a desired temperature is arranged inside the substrate 1101. A cap 2105 is arranged on the top of the substrate 1101 so that the heater 2104 may not be exposed to the plasma. A top cover 2106 makes it possible to vacuum seal the reaction vessel 2100. A matching box 2107 is connected to the cathode electrode 2101, and the matching box 2107 is connected to a high frequency electric power supply 2108. The cathode electrode 2101 is preferably surrounded with a high frequency shield (not shown in the figure) to prevent the leakage of high frequency electromagnetic wave to the surroundings. An evacuation opening 2109 is arranged in the bottom of the reaction vessel 2101, and is connected to an evacuation system 2201 through the intermediary of an evacuation path 2301 and a valve 2501. A pressure gauge 2110 to monitor the pressure inside the vessel is arranged in the evacuation path 2301. A gas introduction pipe 2111, arranged in the reaction vessel 2100 concentrically with the substrate 1101, is connected to a gas feeding system 2400 through the intermediary of a gas feeding path 2302 and a valve 2502. The gas feeding system 2400 is composed of gas cylinders 2411, 2421, 2431, 2441 and 2451; valves 2511 to 2513, 2521 to 2523, 2531 to 2533, 2541 to 2543 and 2551 to 2553; regulators 2412, 2422, 2432, 2442 and 2452; and mass flow controllers 2413, 2423, 2433, 2443 and 2453, and the like.

Examples of the Si-supplying gas to be used for forming an amorphous silicon layer include silicon hydrides (silanes), gaseous or capable of being gasified, such as $SiH_4$, $Si_2H_6$, $Si_3H_8$ and $Si_4H_{10}$; of these silanes, $SiH_4$ and $Si_2H_6$ are particularly preferable from the viewpoints of easy handleability at the time of layer formation and satisfactory efficiency in supplying Si. For the purpose of positively introducing halogens into the photoconductive layer, raw material gases for supplying halogens may be used. For example, halogen gases, halogen compounds, and interhalogen compounds containing halogens can be cited, and these can be used each alone or can be used as diluted with hydrogen or rare gases. In order to attain a desired charging ability, sensitivity, and ghost properties, there can be fed gases containing electroconductivity controlling substances containing the elements of the 13th group in the periodic table for the purpose of regulating the electroconductivity. Examples of such substances include boron hydrides such as $B_2H_6$ and $B_4H_{10}$ and boron halides such as $BF_3$ and $BCl_3$. Additionally, $AlCl_3$, $GaCl_3$ and $InCl_3$ and the like can also be cited. When an electrophotographic photosensitive member for negatively charging is produced, electroconductivity controlling substances containing the elements of the 15th group in the periodic table, represented by $PH_3$ and $P_2H_4$, may also be used. When a gas which contains these electroconductivity controlling substances is introduced, the gas may be used as diluted with $H_2$ and/or rare gases such as He according to need.

After the charge injection blocking layer 1201 and the photoconductive layer 1202, constituted mainly of an amorphous silicon, have been formed on the substrate 1101 by using the apparatus shown in FIG. 5, the intermediate layer 1300 and the surface layer 1401 are formed. When the intermediate layer 1300 and the surface layer 1401 are formed, similarly to the formation of the amorphous silicon layer 1200, there can be used deposited film formation methods such as the glow discharge method (the direct current or alternating current CVD method or the like), the sputtering method, the vacuum deposition method, the ion plating method, the photo-assisted CVD method and the thermal CVD method. Of these methods, the sputtering method which can relatively easily lead to uniform thickness is preferable for the intermediate layer 1300 having the function to control the reflectance. Moreover, in view of the generality of the materials and the easiness in control of conditions, it is desirable that the surface layer is also formed by the sputtering method.

Figure 6:
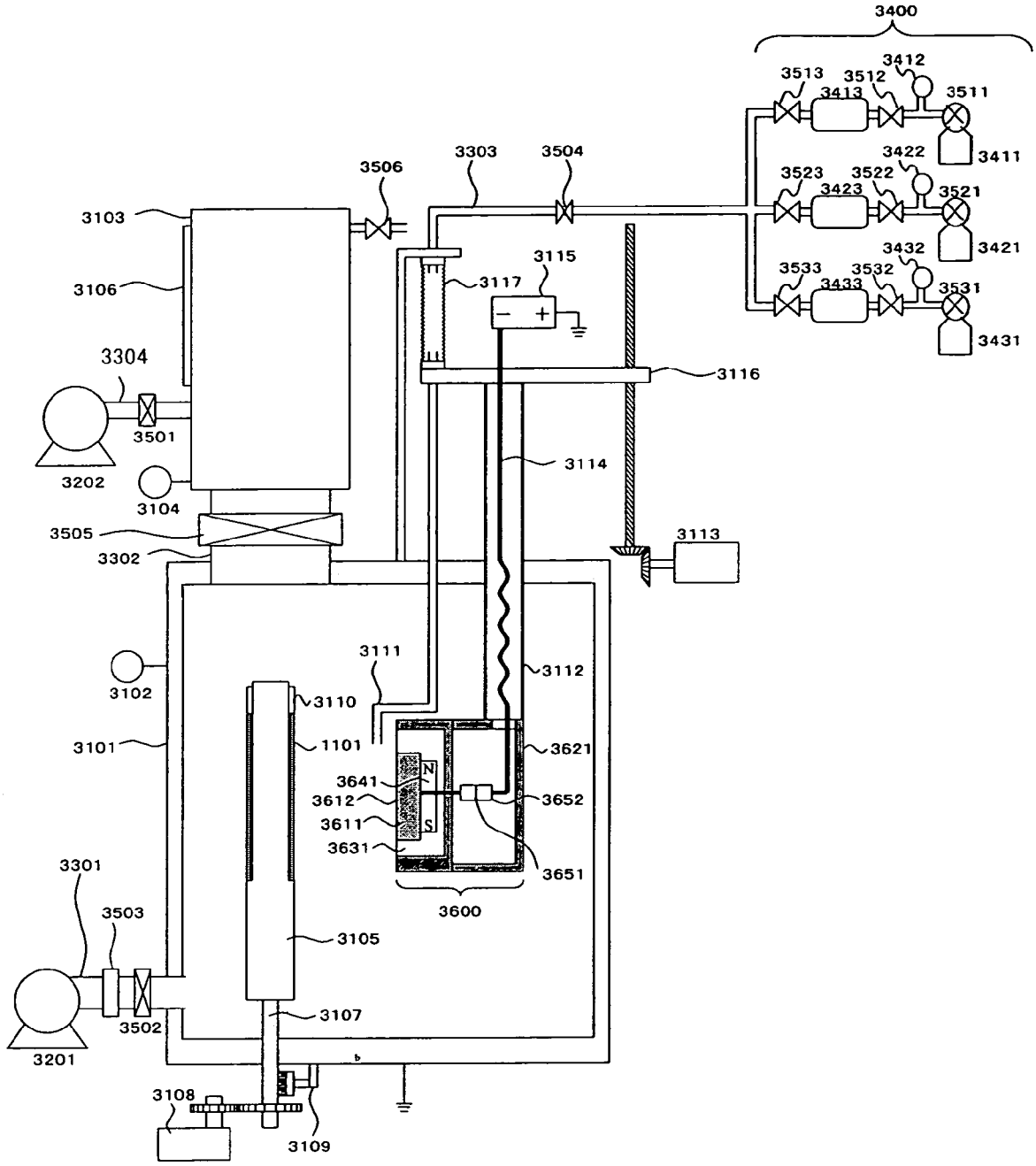
FIG. 6 is a schematic diagram showing an example of a sputtering apparatus for forming on a substrate an intermediate layer and a surface layer involved in the present invention.

FIG. 6 is a schematic diagram showing an example of a sputtering apparatus for forming the intermediate layer 1300 and the surface layer 1401 of the electrophotographic photosensitive member involved in the present invention. A metal-made treatment vessel 3101 for forming deposited film therein is connected to an evacuation system 3201 to evacuate to a vacuum the interior of the treatment vessel 3101 through the intermediary of an evacuation path 3301. The pressure inside the treatment vessel 3101 can be monitored with a pressure gauge 3102. A load lock chamber 3103 for carrying-in/out of a cylindrical substrate 1101 is connected to the upper side of the treatment vessel 3101 through the intermediary of a carrying-in/out path 3302. The load lock chamber 3103 is connected to an evacuation system 3202 for evacuating to a vacuum the interior of the load lock chamber 3103 through the intermediary of an evacuation path 3304. The load lock chamber 3103 is equipped with a pressure gauge 3104, and a lifting/lowering device (not shown in the figure) for carrying-in/out of a substrate 1101 supported by a substrate holder 3105 between the treatment vessel 3101 and the load lock chamber 3103. The substrate is carried in and out by way of a carrying-in/out door 3106 arranged on the load lock chamber 3103.

A rotary shaft 3107 is arranged inside the treatment vessel 3101, and a rotary motor 3108 is driven to permit rotating the substrate 1101. The substrate 1101 is grounded through the intermediary of the substrate holder 3105, the rotary shaft 3107, a grounding member 3109 and the treatment vessel 3101. Moreover, a cap 3110 is arranged on the upper side of the substrate 1101 for the purpose of preventing the deposited film formation inside the substrate 1101. A heater (not shown in the figure) may be arranged inside the substrate holder 3105 to permit heating the substrate 1101.

A gas feeding system 3400 is connected to the treatment vessel 3101 through the intermediary of a gas feeding path 3303, to permit introducing a sputtering gas and a reaction gas from a gas introduction nozzle 3111 into the treatment vessel 3101. The gas feeding system 3400 is composed of gas cylinders 3411, 3421 and 3431; valves 3511 to 3513, 3521 to 3523, and 3531 to 3533; regulators 3412, 3422 and 3432; mass flow controllers 3413, 3423 and 3433; and the like.

As a sputtering gas, a rare gas such as Ar, He, or Xe is used. As a reaction gas, fluorine gas ($F_2$), oxygen gas ($O_2$) or the like is used. The reaction gas is appropriately selected according to the material quality of the desired deposited film. The sputtering gas and the reaction gas may be fed separately from different nozzles.

At a position facing the substrate 1101, a target unit 3600 is arranged. The target unit 3600 is mainly composed of a target 3611 as a sputtering material, a target holder 3621 to hold the target, an insulator 3631 to insulate the target 3611 from the treatment vessel 3101, a magnet 3641, end connections 3651 and 3652 to an electric power supply, and the like. The target unit 3600 is held with a shaft 3112 inside the treatment vessel 3101. The size of the target 3611 is optimized according to the length of the substrate 1101 and the size of the treatment vessel 3101, and the target 3611 can be used repeatedly until the desired thickness distribution and the film properties are hardly obtainable owing to the corrosion, attendant thermal distortion and the like of a sputtering surface 3612. The shape to be adopted of the target 3611 may be a flat plate and a cylinder. The material of the target 3611 is selected according to the type of the deposited film; examples of the target materials to be used include conductive materials such as Mg, Al, La, Ca, Ba and alloys each having a predetermined composition; and insulating materials such as reaction products of these metals, namely, magnesium fluoride, lanthanum fluoride, calcium fluoride, aluminum fluoride, magnesium oxide, lanthanum oxide, titanium oxide, aluminum oxide and silicon oxides. The magnet 3641 is arranged on the side opposite to the sputtering surface 3612 to permit applying a magnetic field parallel to the sputtering surface 3612. Application of a magnetic field leads to generation of a high density plasma in the vicinity of the sputtering surface 3612, so that the number of sputtering particles is increased and the formation rate of the deposited film can be thereby accelerated. The magnetic field intensity is controlled according to the conditions including the formation rate of the deposited film. If there is a possibility such that the target is deformed by the temperature increase thereof and the magnetism of the magnet 3641 is lost by the temperature increase thereof in the course of sputtering, the target 3611 and the magnet 3641 may be cooled by cooling water flowing in cooling pipes (not shown in the figure) arranged respectively in the vicinity of the target 3611 and in the vicinity of the magnet 3641. The target 3611 and the magnet 3641 are held by the insulator 3631 arranged in the target holder 3621, to be insulated from the treatment vessel 3101.

The target holder 3621 is connected to a slider 3116 through the intermediary of the shaft 3112, and the slider 3116 can be moved by a motor 3113 in a direction along the generating line of the substrate 1101. Accordingly, by carrying out sputtering while the target 3611 is being moved, the thickness nonuniformity can be made small. As a device for moving the target 3611 other than the motor, an air cylinder or the like may be used. When sputtering is carried out by introducing a reaction gas, if there is a possibility that the film property nonuniformity and the thickness nonuniformity are generated owing to the concentration distribution of the reaction gas, the gas introduction nozzle 3111 may be made to be movable in a direction along the generating line of the substrate 1101 by the motor 3113 in such a way that a bellows 3117 is incorporated into the gas feeding path 3303 to provide the gas feeding path 3303 with stretchability. When the film properties and adhesiveness may be degraded by sputtering particles obliquely incident onto the surface to deposit a film, a collimator (not shown in the figure) may be arranged between the substrate 1101 and the target 3611 to block the obliquely incident sputtering particles.

When the electrophotographic photosensitive member involved in the present invention is formed, the intermediate layer 1300 and the surface layer 1401 are formed by using different target materials as the case may be. In this case, if the target 3611 is replaced by opening the treatment vessel 3101 to the air every time when a desired layer is formed, the production efficiency is degraded and impurity contamination is caused as the case may be. Accordingly, it is preferable to form the intermediate layer 1300 and the surface layer 1401 without opening the treatment vessel 3101 to the air. Examples of an apparatus configuration which allows formation of the intermediate layer 1300 and the surface layer 1401 without opening the treatment vessel 3101 to the air include a configuration in which a plurality of targets are fixed to the target holder 3621, and sputtering can be conducted with a desired target held in a position so as to make the target face the substrate by rotating the shaft 3112.

The target 3611 is equipped with the end connection 3651 to the electric power supply, and can be connected therefrom to the electric power supply 3115 through the intermediary of another end connection 3652 and an electric power supply cable 3114. The electric power supply 3115 can apply an electric field with the target 3611 as a cathode and the treatment vessel 3101 as an anode. It is to be noted that in the figure, a direct current electric power supply is depicted because the target 3611 is assumed to be a conductive material such as a metal; however, when the target 3611 is an insulating material, a high frequency electric power supply can be used in place of the direct current electric power supply.

In the sputtering apparatus shown in FIG. 6, the substrate 1101 is vertically arranged and the target 3611 is vertically movable, but the substrate 1101 may be horizontally arranged and the target 3611 may be horizontally movable.

Herefore, an example of a sputtering apparatus has been described in which the position of the substrate 1101 is fixed and the target 3611 is moved in the direction along the axial line of the substrate; however, as long as the relative positions of the target 3611 and the substrate 1101 can be varied in the direction along the axial line of the substrate 1101, a moving device may be provided to either of them, and accordingly a moving device such as a motor or an air cylinder may be provided to each of the substrate 1101 and the target 3611 and sputtering may thereby be conducted by moving both of them.

Now, the steps for forming the electrophotographic photosensitive member by use of the apparatuses shown in FIGS. 5 and 6 will be described below. First, a description will be made below of the step for forming an amorphous silicon layer 1200 on the substrate 1101 by use of the plasma CVD apparatus shown in FIG. 5. At the beginning, the substrate 1101 is placed in the reaction vessel 2100 and is sealed with the top cover 2106. Then, the evacuation system 2201 is operated to evacuate to a vacuum the interior of the reaction vessel 2100 with the valve 2501 being opened. Then, while the flow rates of gases to be used for formation of a deposited film are being controlled with the mass flow controllers 2413, 2423, 2433, 2443 and 2553, the treatment gas is introduced into the reaction vessel 2100. In this case, the treatment gas to be used is selected according to the desired functions and film properties, and the flow rate of the treatment gas is also controlled according to the treatment conditions. While the treatment gas is being introduced into the reaction vessel 2100, a high frequency electric power is applied to the electrode 2101 through the intermediary of the matching box 2107 from the high frequency electric power supply 2108, to make the treatment gas a plasma to form the amorphous silicon layer 1200 on the substrate 1101. In this case, the temperature of the substrate 1101 may be appropriately controlled with a heater 2104. The pressure inside the reaction vessel 2100 may be controlled with a throttle valve 2503. After the formation of the amorphous silicon layer 1200 has been completed, a leak valve 2504 is opened to open the interior of the reaction vessel 2100 to the air to take out the substrate 1101.

Next, the intermediate layer 1300 and the surface layer 1401 are formed by use of the sputtering apparatus shown in FIG. 6.

The step for forming the intermediate layer 1300 and the surface layer 1401 by use of the sputtering apparatus shown in FIG. 6 is carried out as follows. Here, description will be made on a step for forming a deposited film in which sputtering is carried out by supplying the direct current electric power to a target formed of a metal. First, the door 3106 of the load lock chamber 3103 is opened, the substrate holder 3105 holding the substrate 1101 having the amorphous silicon layer formed thereon is fixed to the lifting/lowering device, and then the evacuation system 3202 is operated and the valve 3501 is opened to evacuate to a vacuum the interior of the load lock chamber 3103. When oxidation, fluorination, etc. of the sputtered surface 3612 of the target 3611 may accumulate electric charge on the sputtered surface 3612 in this course to generate an arc, it is preferable to remove undesired components on the surface such as oxides and fluorides by presputtering. The presputtering can be carried out as follows. First, the evacuation system 3201 is operated and the valve 3502 is opened to evacuate to a vacuum the interior of the treatment vessel 3101. When the pressure inside the treatment vessel 3101 reaches a predetermined pressure, a sputtering gas is introduced into the treatment vessel 3101 while the flow rate of the sputtering gas is being controlled by means of the mass flow controller 3413. Direct current electric power is supplied from the direct current electric power supply 3115 with the target 3611 as the cathode and the treatment vessel 3101 as the anode to make the sputtering gas a plasma in the vicinity of the target 3611. The cations in the plasma collide with the sputtered surface 3612 of the target 3611 to remove the oxide film on the sputtered surface 3612. In this case, the pressure inside the treatment vessel 3101 may be controlled by regulating the opening degree of a throttle valve 3503 equipped in the evacuation path 3301. In the course of the presputtering, by monitoring the generation frequency of arcs generated on the sputtered surface 3612 and the voltage value, the current value and the like of the direct current electric power supply 3115, the removal of the oxide film and the fluoride film can be judged to be completed when these values becomes steady. When the presputtering is terminated, the supply of the direct current electric power is stopped, and the valve 3504 and the valves 3511 to 3513 are closed to stop the introduction of the sputtering gas.

After the presputtering has been completed and the pressure inside the load lock chamber 3103 has reached a predetermined value, the valve 3501 is closed and the valve 3505 is opened to carry the substrate 1101 into the treatment vessel 3101 and the substrate 1101 is held by the rotary shaft 3107. Then, the valve 3504 in the gas feeding path 3303 is opened, and the sputtering gas and reaction gas to be used for deposited film formation are introduced into the treatment vessel 3101 while regulating the flow rates with the mass flow controllers 3413, 3423 and 3433. In this case, the reaction gas may be diluted with hydrogen gas, a rare gas or the like, and a plurality of reaction gases may be introduced. After the sputtering gas and the reaction gas have been introduced, direct current electric power is supplied from the direct current electric power supply 3115 to the target 3611 to generate a plasma. It is preferable to regulate the pressure inside the treatment vessel 3101 to a predetermined value by use of the throttle valve 3503 in the evacuation path 3301 in the course of the sputtering. The sputtering particles sputtered by the plasma react with the reaction gas on the substrate 1101 to form the deposited film. While forming the deposited film, the motor 3113 for moving the target is driven to move the target 3611 in the direction along the generating line of the substrate 1101. The moving speed of the target 3611 and the number of back and forth movements are optionally controlled according to the deposited film forming conditions including the formation time of the deposited film. The movement range of the target 3611 is optionally controlled according to the tolerable nonuniformity of the thickness, and it is preferable that the target 3611 is moved within a range longer than the substrate 1101. By carrying out sputtering while the substrate 1101 is being rotated with the rotary shaft, the thickness nonuniformity along the circumferential direction of the substrate 1101 can be reduced.

At the time when a predetermined formation time of the deposited film has passed, the gas introduction is stopped by closing the valve 3504 and the valves connected to the cylinders of the sputtering gases and the reaction gases, and supply of the direct current electric power to the target 3611 is also stopped. Then, the sputtering of the target to be used for the formation of the second intermediate layer 1302 or the surface layer 1401 is carried out according to similar procedures, and the intermediate layer 1302 or the surface layer 1401 is formed on the substrate 1101. In this case, the following procedures may be adopted: the substrate 1101 is once carried into the load lock chamber 3103, the presputtering of the target to be used for the formation of the second intermediate layer 1302 or the surface layer 1401 is carried out, and the substrate 1101 is again carried into the treatment vessel 3101 to be subjected to sputtering.

After the formation of the surface layer 1401 has been completed, the interior of the treatment vessel 3301 and the insides of the pipes of the gas feeding system 3400 are purged. Then, the substrate 1101 is carried into the load lock chamber 3103, the load lock chamber 3103 is made to get back to the atmospheric pressure by opening a leak valve 3506, and then the substrate 1101 is taken out into the air.

It is to be noted that a description has been made of the method in which sputtering is carried out by using a conductive material for the target 3611 and by applying direct current electric power, but high frequency electric power can be applied to the target 3611 when insulating materials such as magnesium fluoride, lanthanum fluoride, calcium fluoride, aluminum fluoride, magnesium oxide, lanthanum oxide, titanium oxide, aluminum oxide and silicon oxides are used for the target 3611.

Now, the examples of the present invention will be described below with reference to the accompanying drawings.

EXAMPLE 1

An amorphous silicon layer was formed by use of the CVD apparatus shown in FIG. 5, then an intermediate layer composed of a metal oxide and a surface layer composed of a metal fluoride are formed by use of the sputtering apparatus shown in FIG. 6 to produce an electrophotographic photosensitive member, and the electric potential properties thereof were evaluated.

First, a charge injection blocking layer and a photoconductive layer mainly composed of amorphous silicon were formed by use of the CVD apparatus shown in FIG. 5. As the substrate, an aluminum cylinder of 80 mm in diameter and 358 mm in length was used. The forming conditions of the amorphous silicon layer are shown in Table 1.

TABLE 1

| | Charge injection blocking layer | Photoconductive layer |
|---|---|---|
| Gases and flow rates | | |
| $SiH_4$ (ml/min. [normal]) | 100 | 100 |
| $B_2H_6$ (ppm, based on $SiH_4$) | 2000 | 0.5 |
| NO (ml/min. [normal]) | 5 | |
| Substrate temperature (° C.) | 250 | 250 |
| Pressure inside the reaction vessel (Pa) | 70 | 70 |
| High frequency electric power (kW) | 0.1 | 0.1 |
| Thickness (μm) | 3 | 30 |

The frequency of the used electric power supply was 13.56 MHz.

The charge injection blocking layer and the photoconductive layer were formed, then a 150 nm thick intermediate layer composed of magnesium oxide was formed by use of the sputtering apparatus shown in FIG. 6, and an 800 nm thick surface layer composed of magnesium fluoride was formed thereon. The conditions for forming magnesium oxide and magnesium fluoride layers, respectively, are shown in Table 2.

TABLE 2

| | Conditions for film deposition | | | | | |
|---|---|---|---|---|---|---|
| | Target | Gas flow rate (ml/min. [normal]) | | | Pressure inside the treatment vessel | Direct current electric power |
| Constituent | material | Ar | $O_2$ | $F_2$ | (Pa) | (kW) |
| Magnesium oxide | Mg | 250 | 20 | | 0.5 | 0.5 |
| Magnesium fluoride | Mg | 250 | | 20 | 0.5 | 0.5 |

The obtained electrophotographic photosensitive member was set in a digital copying machine (iR6000 manufactured by Canon Inc., modified for test use), and the electric potential properties thereof were measured according to the following procedures. First, the obtained electrophotographic photosensitive member was installed in the copying machine, corona charging was carried out by applying a high voltage of +6 kV to a charger, and the dark-area surface potential of the drum measured with a surface potential meter was taken as the charging ability. The electrophotographic photosensitive member was charged so as to have a dark-area surface potential of 450 V, and then exposed to incident laser light. The light quantity to give the exposed surface electric potential of 200 V was measured as the sensitivity. Then, the obtained electrophotographic photosensitive member was charged so as to have a dark-area surface potential of 450 V at the developing position, and subsequently exposed to a laser light with a light quantity of 2 lux-sec. The light-area surface potential of the drum at this time was taken as the residual electric potential. In these electric potential measurements, the wavelength of the used exposure laser light was 660 nm. After the measurements of the electric potentials, the image was output by use of a full-page character chart on a white background and the presence or absence of the image deletion was investigated. The environment for image output was set at 30° C. and 80% RH. In this case, the spot size of the exposure laser light was about 60 μm×about 65 μm (main scanning direction spot diameter×sub-scanning direction spot diameter). Moreover, the light source for the exposure laser light was replaced with a semiconductor laser having a main oscillation wavelength of 405 nm, an image was output by use of the full-page character chart on a white background, and the presence or absence of the image deletion was investigated. In this case, the spot size of the exposure laser light was about 30 μm×about 40 μm (main scanning direction spot diameter× sub-scanning direction spot diameter).

COMPARATIVE EXAMPLE 1

An amorphous silicon layer was formed by use of the CVD apparatus shown in FIG. 5, then a surface layer composed of magnesium fluoride was formed by use of the sputtering apparatus shown in FIG. 6 to produce an electrophotographic photosensitive member, and the electric potential properties thereof were evaluated.

The same substrate as in Example 1 was used, and the formation procedures and the forming conditions for the charge injection blocking layer and the photoconductive layer were the same as in Example 1.

The charge injection blocking layer and the photoconductive layer were formed, and then an 800 nm thick surface layer composed of magnesium fluoride was formed by use of the sputtering apparatus shown in FIG. 6. The forming conditions for the magnesium fluoride film were the same as in Example 1.

For the obtained electrophotographic photosensitive member, the electric potential properties and the image deletion were evaluated according to the same procedures as in Example 1.

COMPARATIVE EXAMPLE 2

An amorphous silicon layer and an intermediate layer composed of a-SiC:H were successively formed by use of the CVD apparatus shown in FIG. 5, then a surface layer composed of a metal fluoride was formed by use of the sputtering apparatus shown in FIG. 6 to produce an electrophotographic photosensitive member, and the electric potential properties thereof were evaluated.

The same substrate as in Example 1 was used, and the formation procedures and the forming conditions for a charge injection blocking layer and a photoconductive layer were the same as in Example 1. The charge injection blocking layer and the photoconductive layer were formed, and then the intermediate layer composed of a-SiC:H was formed. The forming conditions for the a-SiC:H intermediate layer are shown in Table 3.

TABLE 3

| | Surface layer |
|---|---|
| Gases and flow rates | |
| $SiH_4$ (ml/min. [normal]) | 10 |
| $CH_4$ (ml/min. [normal]) | 400 |
| Substrate temperature (° C.) | 250 |
| Pressure inside the reaction vessel (Pa) | 60 |
| High frequency electric power (kW) | 0.1 |

On going from the photoconductive layer to the intermediate layer, discharge was not interrupted and the flow rate for the introduced gas was continuously changed in one minute. And, under the condition such that the flow rate of the introduced gas was steady, a 150 nm thick a-SiC:H film was formed.

After the intermediate layer was formed, a 800 nm thick surface layer composed of magnesium fluoride was formed by use of the sputtering apparatus shown in FIG. 6. The forming conditions for the surface layer were the same as in Example 1.

For the obtained electrophotographic photosensitive member, the electric potential properties and the image deletion thereof were evaluated according to the same procedures as in Example 1.

For the electrostatic capacities, sensitivities and residual electric potentials measured in Example 1 and Comparative Example 2, the ratios of these quantities to those of Comparative Example 1 were derived and these quantities were evaluated on the basis of the following evaluation standards.

◎: Improved by 20% or more in relation to Comparative Example 1.

○: Improved by 10 to 20% in relation to Comparative Example 1.

Δ: Improved by 0 to 10% in relation to Comparative Example 1.

The evaluation results of these quantities are collectively shown in Table 4.

TABLE 4

| | Charging ability | Sensitivity | Residual electric potential |
|---|---|---|---|
| Example 1 | ◎ | ◎ | ◎ |
| Comparative Example 1 | Δ | Δ | Δ |
| Comparative Example 2 | Δ | ◎ | ◎ |

As can be seen from Table 4, the charging ability is not sufficiently satisfactory in Comparative Example 2 in which an a-SiC:H film was used for the intermediate layer. On the contrary, the charging ability, sensitivity and residual electric potential are all satisfactory in the case in which an intermediate layer composed of magnesium oxide was formed. From the above, it can be seen that when a metal fluoride is provided to the surface layer, an electrophotographic photosensitive member having excellent electric potential properties can be obtained by providing a metal oxide for the intermediate layer.

Next, description will be made of the evaluation of the image deletion. When the spot diameter of the exposure laser light was about 60 μm, in any one of Example 1 and Comparative Examples 1 and 2, no image deletion was observed. On the other hand, when the spot diameter was reduced to about 30 μm by making the wavelength of the exposure laser light to be 405 nm, the image deletion was not manifested in Example 1 for a case where an intermediate layer composed of a metal oxide was provided, but the image deletion was manifested to somewhat extent in Comparative Example 1 for a case where magnesium fluoride was formed directly on the amorphous silicon layer. In other words, even when the resolution was enhanced, the image deletion could be effectively suppressed by providing a metal oxide for the intermediate layer. Additionally, in Comparative Example 2, when the spot diameter of the incident laser light was about 35 μm, no image acceptable for evaluation could be formed.

In the present Example, magnesium oxide was used for the intermediate layer, but even when there was provided an intermediate layer composed of other metal oxides such as aluminum oxide, titanium oxide and lanthanum oxide, it was possible to obtain electrophotographic photosensitive members in each of which electric potential properties were satisfactory and the image deletion caused by the charge drift was hardly generated.

EXAMPLE 2

An amorphous silicon layer was formed by use of the CVD apparatus shown in FIG. 5, and then an intermediate layer composed of a metal oxide and a surface layer composed of a metal fluoride were formed by use of the sputtering apparatus shown in FIG. 6 to produce an electrophotographic photosensitive member for which the greatest value of reflectance was 20% or less. For the electrophotographic photosensitive member, the initial electric potential properties, the image in the print durability test, and the sensitivity nonuniformity, the sensitivity variation width and the greatest value of reflectance were evaluated.

In the present Example, an electrophotographic photosensitive member was produced by the same procedures as in Example 1, and the thickness values of the intermediate layer and the surface layer were made the same as those in Example 1. In the present Example, the constituents used respectively for the photoconductive layer, the intermediate layer and the surface layer were formed separately on glass substrates (glass substrate 7059 manufactured by Corning Inc.), and the refractive indices of these layers were measured by use of an ultraviolet spectrophotometer (V-570 manufactured by JASCO Co., Ltd.). The refractive indices obtained are collectively shown in Table 5.

TABLE 5

| | Constituent | Refractive index |
|---|---|---|
| Photoconductive layer | a-Si:H | 3 |
| Intermediate layer | Magnesium oxide | 1.73 |
| Surface layer | Magnesium fluoride | 1.4 |

The obtained electrophotographic photosensitive member was set in a digital copying machine (iR6000 manufactured by Canon Inc., modified for test use) and was subjected to the following measurement of the electric potential properties thereof and the following print durability test. In the copying machine, a semiconductor laser with a main oscillation wavelength of 405 nm was mounted as the light source for forming an electrostatic latent image. The spot size of the exposure laser light was about 30 μm×about 40 μm (spot diameter in a main scanning direction×spot diameter in a sub-scanning direction). Image exposure was carried out in such a way that the incidence angle for the main scanning direction of the exposure laser light was 0° at the center of the electrophotographic photosensitive member and was varied within a range of about ±16° at the ends of the image. Modification of the cleaning roller member was such that the cleaning roller was changed from a magnet roller to a sponge roller made of urethane rubber, and accordingly durability test was carried out under the conditions that accelerate the abrasion of the surface layer.

First, the charging ability, sensitivity and residual electric potential of the obtained electrophotographic photosensitive member were measured by the same procedures as in Example 1. Then, the print durability test was carried out which included the measurements of nonuniformity and variation width of the sensitivity, and the greatest value of reflectance. In the course of the durability test, the evaluations were carried out under the conditions that the built-in heater in the electrophotographic photosensitive member originally mounted in the copying machine was not operated.

In an environment of a temperature of 30° C. and a humidity of 80% RH, a durability test was carried out in which 500 thousand sheets of an image having a pixel density of 50% were output. In this durability test, for every 20 thousand sheets of the output image, the image density when the interference pattern was transcribed on the image was measured, and the ratio of the image density for the highest density area to the image density for the lowest density area was derived to evaluate the transcription of the interference pattern. Measurement of the abrasion amount of the magnesium fluoride film after performing the durability test revealed that the smallest abrasion was about 300 nm and the largest abrasion was about 400 nm.

In addition to the durability test, the sensitivity was measured according to the same procedures as in Example 1. The sensitivity was measured for every 30 mm from the center along the direction of the generating line of the electrophotographic photosensitive member, and the sensitivity nonuniformity was obtained by deriving the ratio of the lowest sensitivity to the highest sensitivity. Also, the sensitivity was measured for every 20 thousand sheets of the print durability test, and the largest sensitivity nonuniformity throughout the print durability test was taken as the maximum sensitivity nonuniformity for evaluation. In the central portion of the electrophotographic photosensitive member, the ratio of the lowest sensitivity to the highest sensitivity throughout the durability test was derived, and the ratio was taken as the variation width of the sensitivity for evaluation. The reflectance for the light of 405 nm in wavelength was measured by use of a reflection spectrometric interferometer (MCPD 3000 manufactured by Otsuka Electronics Co., Ltd.). This measurement was carried out in such a way that the location along the direction of the generating line of the electrophotographic photosensitive member in the copying machine corresponded to the incidence angle of the laser light. The reflectance measurement was carried out for the locations along the direction of the generating line corresponding to even intervals of 1° of the incidence angle of the laser light; the greatest value of reflectance was investigated in such a way that the above measurement was carried out before the durability test and for every 50 thousand sheets of the durability test.

COMPARATIVE EXAMPLE 3

An amorphous silicon layer was formed by use of the CVD apparatus shown in FIG. 5, and then a surface layer composed of magnesium fluoride was formed by use of the sputtering apparatus shown in FIG. 6 to produce an electrophotographic photosensitive member. For the electrophotographic photosensitive member, the initial electric potential properties, the image in the print durability test, the sensitivity nonuniformity, the sensitivity variation width and the greatest value of reflectance were evaluated.

In the present Comparative Example, the electrophotographic photosensitive member was produced by forming the surface layer composed of magnesium fluoride directly on the photoconductive layer according to the same procedures as in Comparative Example 1. For the electrophotographic photosensitive member, the initial electric potential properties, the sensitivity nonuniformity and the sensitivity variation width in the print durability test, the transcription state of the interference pattern and the greatest value of reflectance were evaluated according to the same method as in Example 1.

In Example 2, for the initial charging ability, the sensitivity and the residual electric potential, the sensitivity nonuniformity and the sensitivity variation width in the course of the durability test, and the transcription of the interference pattern, the ratios of these quantities to those of Comparative Example 3 were derived and evaluated according to the following evaluation standards.

◎: Improved by 20% or more in relation to Comparative Example 3.

○: Improved by 10 to 20% in relation to Comparative Example 3.

Δ: Improved by 0 to 10% in relation to Comparative Example 3.

The evaluation results of these quantities, and the greatest value of reflectance in each of the experiments concerned are collectively shown in Table 6.

TABLE 6

| | Charging ability | Sensitivity | Residual electric potential | Sensitivity nonuniformity | Sensitivity variation width | Transcription of interference pattern | Greatest value of reflectance (%) |
|---|---|---|---|---|---|---|---|
| Example 2 | ○ | ◎ | ◎ | ○ | ○ | ○ | 17 |
| Comparative Example 3 | Δ | Δ | Δ | Δ | Δ | Δ | 29 |

As can be seen from Table 6, in a contrast to Comparative Example 3, when between the surface layer composed of magnesium fluoride and the photoconductive layer, an intermediate layer composed of magnesium oxide was formed so as for the greatest value of reflectance to be 20% or less, electric potential properties better than those in Comparative Example 3 in which the magnesium fluoride film was formed directly on the photoconductive layer could be obtained, and additionally, the transcription of the interference pattern could be suppressed. Additionally, it can be seen that an electrophotographic photosensitive member which was satisfactory both in the sensitivity nonuniformity and in the sensitivity variation width and provided images with high image quality could be obtained.

In the present example, magnesium oxide was used for the intermediate layer, but even when there was provided an intermediate layer composed of other metal oxides such as aluminum oxide, titanium oxide and lanthanum oxide, there were obtained electrophotographic photosensitive members which were satisfactory in the transcription of the interference pattern and small both in the sensitivity nonuniformity and in the sensitivity variation by regulating the thickness of the intermediate layer so as for the greatest value of reflectance to be 20% or less.

EXAMPLES 3 TO 5

In each of Examples 3 to 5, an amorphous silicon layer was formed by use of the CVD apparatus shown in FIG. 5, then an intermediate layer composed of magnesium oxide and having a thickness different from that in Example 2 was formed by use of the sputtering apparatus shown in FIG. 6, and then a surface layer composed of magnesium fluoride was formed to produce an electrophotographic photosensitive member. For each of the produced electrophotographic photosensitive members, the initial electric potential properties, the image in the print durability test, the sensitivity nonuniformity, the sensitivity variation width and the greatest value of reflectance were evaluated.

In each of Examples 3 to 5, the same substrate as in Example 1 was used, and the formation procedures and the forming conditions for the charge injection blocking layer and the photoconductive layer were the same as in Example 1.

In each of Examples 3 to 5, after the charge injection blocking layer and the photoconductive layer were formed, the intermediate layer composed of magnesium oxide and the surface layer composed of magnesium fluoride were formed by use of the sputtering apparatus shown in FIG. 6, the forming conditions of the intermediate layer and the surface layer being the same as in Example 1. Table 7 shows thickness combinations of the magnesium oxide film and the magnesium fluoride film for respective Examples.

TABLE 7

| | Intermediate layer constituent | Thickness of intermediate layer (nm) | Surface layer constituent | Thickness of surface layer (nm) |
|---|---|---|---|---|
| Example 3 | Magnesium oxide | 200 | Magnesium fluoride | 800 |
| Example 4 | | 250 | | |
| Example 5 | | 300 | | |

For each of the obtained electrophotographic photosensitive members, according to the same procedures as in Example 2, the initial electric potential properties were evaluated, and the sensitivity nonuniformity, the sensitivity variation width, the transcription state of the interference pattern and the greatest value of reflectance were evaluated in the print durability test.

In each of Examples 3 to 5, for the initial charging ability, the sensitivity and the residual electric potential, the sensitivity nonuniformity and the sensitivity variation width in the course of the durability test, and the transcription of the interference pattern, the ratios of these quantities to those of Comparative Example 3 were derived and evaluated according to the following evaluation standards.

◎: Improved by 20% or more in relation to Comparative Example 3.

○: Improved by 10 to 20% in relation to Comparative Example 3.

Δ: Improved by 0 to 10% in relation to Comparative Example 3.

These evaluation results and the greatest value of reflectance in each of the experiments concerned are collectively shown in Table 8, together with the evaluation results for Example 2.

TABLE 8

| | Thickness of intermediate layer (nm) | Charging ability | Sensitivity | Residual electric potential | Sensitivity nonuniformity | Sensitivity variation width | Transcription of interference patterns | Greatest value of reflectance (%) |
|---|---|---|---|---|---|---|---|---|
| (Example 2) | 150 | ○ | ◎ | ◎ | ○ | ○ | ○ | 17 |
| Example 3 | 200 | ◎ | ◎ | ◎ | ○ | Δ | ○ | 23 |
| Example 4 | 250 | ◎ | ◎ | ◎ | Δ | Δ | Δ | 27 |
| Example 5 | 300 | ◎ | ◎ | ◎ | ○ | ○ | ◎ | 15 |

As can be seen from Table 8, in every Example, satisfactory electric potential properties could be obtained, but when the thickness of the intermediate layer was increased from the thickness concerned in Example 2, the greatest value of reflectance was once increased and then took a downward turn. In every Example, when the thickness was increased and the greatest value of reflectance thereby exceeded 20%, the sensitivity variation width was degraded and the transcription of the interference pattern on the image tended to be degraded. With a further increase of the thickness, the greatest value of reflectance became small, and the sensitivity variation width and the transcription of the interference pattern were made satisfactory. From the above, it can be seen that the greatest value of reflectance is needed to be 20% or less for the purpose of reducing the sensitivity variation width and the sensitivity nonuniformity and suppressing the transcription of the interference pattern.

In each of the present Examples, magnesium oxide was used for the intermediate layer. However, there were produced electrophotographic photosensitive members varied in the thickness of the intermediate layer composed of other metal oxides such as aluminum oxide, titanium oxide and lanthanum oxide. For each of the thus produced electrophotographic photosensitive members, the transcription state of the interference pattern, the sensitivity nonuniformity, the sensitivity variation width, and the highest reflectance were evaluated in the print durability test. Consequently, when the thickness of the intermediate layer was controlled so as for the greatest value of reflectance to be 20% or less, there were obtained electrophotographic photosensitive members in which the transcription of the interference pattern was suppressed, and the sensitivity nonuniformity and the sensitivity variation width were small.

EXAMPLES 6 TO 12

In each example, an amorphous silicon layer was formed by use of the CVD apparatus shown in FIG. 5, then an intermediate layer composed of magnesium oxide and having a thickness controlled so as to have an m value in formula (2) being any one of 1 to 7, and a surface layer composed of magnesium fluoride were formed by use of the sputtering apparatus shown in FIG. 6 to produce an electrophotographic photosensitive member. For each of the produced electrophotographic photosensitive member, the initial electric potential properties were evaluated, and also, the image in the print durability test, the sensitivity nonuniformity and the sensitivity variation width, and the greatest value of reflectance were evaluated.

In each example, a charge injection blocking layer and a photoconductive layer were formed by use of the CVD apparatus shown in FIG. 5 under the same conditions as in Example 1, then an intermediate layer composed of magnesium oxide and having a thickness to give an m value in formula (2) being any one of 1 to 7, and thereon a 800 nm thick surface layer composed of magnesium fluoride were formed by use of the sputtering apparatus shown in FIG. 6. For the λ value in formula (2), the main oscillation wavelength of the exposure laser light, namely, 405 nm was substituted. In each example, the forming conditions for the intermediate layer and the surface layer were the same as in Example 1. Table 9 shows combinations of the intermediate layer and the surface layer for respective Examples.

TABLE 9

| | Thickness of intermediate layer (nm) | Value of m in formula (2) | Thickness of surface layer (nm) |
|---|---|---|---|
| Example 6 | 60 | 1 | 800 |
| Example 7 | 180 | 2 | |
| Example 8 | 290 | 3 | |
| Example 9 | 410 | 4 | |
| Example 10 | 530 | 5 | |
| Example 11 | 640 | 6 | |
| Example 12 | 760 | 7 | |

For each of the electrophotographic photosensitive members obtained in the respective Examples, according to the same procedures as in Example 2, the initial electric potential properties were evaluated, and the sensitivity nonuniformity and the sensitivity variation width in the print durability test, the transcription state of the interference pattern and the greatest value of reflectance were evaluated.

In Examples 6 to 12, for the initial charging ability, the sensitivity and the residual electric potential, and the sensitivity nonuniformity and the sensitivity variation width in the print durability test, and the transcription of the interference pattern, the ratios of these quantities to those of Comparative Example 3 were derived and evaluated according to the following evaluation standards.

◎: Improved by 20% or more in relation to Comparative Example 3.

○: Improved by 10 to 20% in relation to Comparative Example 3.

Δ: Improved by 0 to 10% in relation to Comparative Example 3.

The evaluation results of these quantities, and the greatest value of reflectance in each of the experiments concerned are collectively shown in Table 10.

TABLE 10

| | Value of m in formula (2) | Charging ability | Sensitivity | Residual electric potential | Sensitivity nonuniformity | Sensitivity variation width | Transcription of interference patterns | Greatest value of reflectance (%) |
|---|---|---|---|---|---|---|---|---|
| Example 6 | 1 | ○ | ○ | ○ | ◎ | ◎ | ◎ | 10 |
| Example 7 | 2 | ○ | ◎ | ◎ | ◎ | ◎ | ◎ | 12 |
| Example 8 | 3 | ◎ | ◎ | ◎ | ○ | ◎ | ◎ | 14 |
| Example 9 | 4 | ◎ | ◎ | ◎ | ○ | ○ | ◎ | 15 |
| Example 10 | 5 | ◎ | ◎ | ◎ | ○ | ○ | ○ | 18 |
| Example 11 | 6 | ◎ | ◎ | ◎ | ○ | Δ | ○ | 24 |
| Example 12 | 7 | ◎ | ◎ | ◎ | Δ | Δ | Δ | 28 |

As can be seen from Table 10, when the respective intermediate layers each composed of the relevant material were formed so as to satisfy formula (2), satisfactory initial electric potential properties could be obtained in every example, and the greatest value of reflectance was decreased with decreasing m value. With this decrease, the transcription of the interference pattern, the sensitivity nonuniformity and the sensitivity variation width were improved. In particular, it can be seen that the m values of formula (2) falling within a range from 1 to 5 were satisfactory.

In each of the present Examples, magnesium oxide was used for the intermediate layer. However, even when intermediate layers respectively composed of other metal oxides such as aluminum oxide, titanium oxide and lanthanum oxide were formed in such a way that the thickness of each of the intermediate layers was controlled so as to satisfy formula (2), there were obtained, for the m values in formula (2) falling within a range from 1 to 5, electrophotographic photosensitive members in each of which the transcription of the interference pattern was satisfactorily slight, and both nonuniformity and variation in sensitivity were small.

EXAMPLES 13 TO 18

In each example, an amorphous silicon layer was formed by use of the CVD apparatus shown in FIG. 5, then, by use of the sputtering apparatus shown in FIG. 6, an intermediate layer composed of magnesium oxide and having a thickness controlled so as to deviate by an integral multiple of $\pm\lambda/16n$ from the thickness satisfying formula (2) and a surface layer composed of magnesium fluoride were formed to produce an electrophotographic photosensitive member. For each of the produced electrophotographic photosensitive members, the initial electric potential properties were evaluated, and the image in the print durability test, the sensitivity nonuniformity and the sensitivity variation width, and the greatest value of reflectance were evaluated.

In each example, a charge injection blocking layer and a photoconductive layer were formed by use of the CVD apparatus shown in FIG. 5 under the same conditions as in Example 1, and then, by use of the sputtering apparatus shown in FIG. 6, an intermediate layer composed of magnesium oxide and having a thickness deviating by an integral multiple of $\pm\lambda/16n$ from the thickness satisfying formula (2) with an m value of 2, and thereon a surface layer composed of magnesium fluoride were formed. For the $\lambda$ value in formula (2), the main oscillation wavelength of the exposure laser light, namely, 405 nm was substituted. In each example, the forming conditions for the intermediate layer and the surface layer were the same as in Example 1. Table 11 shows combinations of the intermediate layer and the surface layer for respective Examples.

TABLE 11

| | Thickness of intermediate layer (nm) | Thickness deviation from Example 7 |
|---|---|---|
| Example 13 | 125 | $-3\lambda/16n$ |
| Example 14 | 140 | $-2\lambda/16n$ |
| Example 15 | 155 | $-\lambda/16n$ |
| Example 16 | 195 | $+\lambda/16n$ |
| Example 17 | 210 | $+2\lambda/16n$ |
| Example 18 | 225 | $+3\lambda/16n$ |

For each of the electrophotographic photosensitive members obtained in the respective Examples, according to the same procedures as in Example 2, initial electric potential properties were evaluated, and the sensitivity nonuniformity and sensitivity variation width in the print durability test, the transcription state of interference pattern and the greatest value of reflectance were evaluated.

In each of Examples 13 to 18, for initial charging ability, sensitivity and residual electric potential, and sensitivity nonuniformity and sensitivity variation width in the course of the durability test, and the transcription of interference pattern, the ratios of these quantities to those of Comparative Example 3 were derived and evaluated according to the following evaluation standards.

◎: Improved by 20% or more in relation to Comparative Example 3.

○: Improved by 10 to 20% in relation to Comparative Example 3.

Δ: Improved by 0 to 10% in relation to Comparative Example 3.

The evaluation results of these quantities, and the greatest value of reflectance in each of the experiments concerned are collectively shown in Table 12, together with the evaluation results for Example 7.

TABLE 12

| | Film thickness of intermediate layer (nm) | Thickness deviation from Example 7 | Charging ability | Sensitivity | Residual electric potential | Sensitivity nonuniformity | Sensitivity variation width | Transcription of interference pattern | Greatest value of reflectance (%) |
|---|---|---|---|---|---|---|---|---|---|
| Example 13 | 125 | −3λ/16n | ○ | ◎ | ○ | ○ | Δ | Δ | 25 |
| Example 14 | 140 | −2λ/16n | ○ | ◎ | ◎ | ○ | Δ | ○ | 22 |
| Example 15 | 155 | −λ/16n | ○ | ◎ | ◎ | ○ | ○ | ◎ | 15 |
| (Example 7) | 180 | — | ○ | ◎ | ◎ | ◎ | ◎ | ◎ | 12 |
| Example 16 | 195 | +λ/16n | ◎ | ◎ | ◎ | ○ | ○ | ○ | 16 |
| Example 17 | 210 | +2λ/16n | ◎ | ◎ | ◎ | ○ | Δ | Δ | 23 |
| Example 18 | 225 | +3λ/16n | ◎ | ◎ | ◎ | ○ | Δ | Δ | 26 |

As can be seen from Table 12, in every Example, satisfactory initial electric potential properties could be obtained; when the thickness deviation was of the order of ±λ/16n from the thickness satisfying formula (2), sensitivity nonuniformity and sensitivity variation width, and the transcription of interference pattern were all not drastically degraded. When thickness deviation exceeded ±λ/16n, sensitivity variation width tended to start degradation and the transcription of interference tended to start manifestation. From the above, it can be seen that when the thickness nonuniformity fell within a range of ±λ/16n from the thickness satisfying formula (2), the image quality degradation caused by the interference could be effectively suppressed.

In each of the present Examples, magnesium oxide was used for the intermediate layer. However, even when the intermediate layer was formed by use of other metal oxides such as aluminum oxide, titanium oxide and lanthanum oxide in such a way that the thickness of the intermediate layer was deviated from the thickness satisfying formula (2), there were obtained, within a deviation range of ±λ/16n from the thickness satisfying formula (2), electrophotographic photosensitive members which were satisfactory in the transcription of the interference pattern and small in sensitivity nonuniformity and sensitivity variation.

EXAMPLES 19 TO 25

In each example, an amorphous silicon layer was formed by use of the CVD apparatus shown in FIG. 5, then by use of the sputtering apparatus shown in FIG. 6, an intermediate layer in which the refractive index and the thickness were controlled so as for the intermediate layer to acquire antireflection capability and a surface layer composed of magnesium fluoride were formed to produce an electrophotographic photosensitive member. For each of the produced electrophotographic photosensitive members, the initial electric potential properties were evaluated, and the image in the print durability test, the sensitivity nonuniformity, the sensitivity variation width and the greatest value of reflectance were evaluated.

In the present Examples, at the beginning, for the case in which the intermediate layer is composed of one layer, the refractive index of the intermediate layer required for exhibiting antireflection capability was derived on the basis of formula (4) to obtain a value of 2.05. Accordingly, lanthanum oxide having a refractive index (around 1.95) close to this value was selected for the intermediate layer.

In each example, a charge injection blocking layer and a photoconductive layer were formed under the same conditions as in Example 1 by use of the CVD apparatus shown in FIG. 5, and then by use of the sputtering apparatus shown in FIG. 6, an intermediate layer composed of lanthanum oxide was formed so as to have a thickness to give the m value in formula (2) being any one of 1 to 7. For the λ value in formula (2), the main oscillation wavelength of the exposure laser light, namely, 405 nm was substituted. Table 13 shows the conditions for forming a lanthanum oxide film and the refractive index under the same forming conditions.

TABLE 13

| | Forming conditions of deposited film | | | | | |
|---|---|---|---|---|---|---|
| | Target | Gas flow rate (ml/min. [normal]) | | Pressure inside the treatment vessel | DC electric power | Refractive |
| Constituent | material | Ar | $O_2$ | (Pa) | (kW) | index |
| Lanthanum oxide | La | 250 | 20 | 0.5 | 0.5 | 1.98 |

In each example, an intermediate layer was formed, and then a 800 nm thick surface layer composed of magnesium fluoride was formed, the forming conditions for the surface layer being the same as in Example 1.

Table 14 shows combinations of the thickness of the intermediate layer and the surface layer for the respective Examples.

TABLE 14

| | Film thickness of intermediate layer (nm) | Value of m in formula (2) | Film thickness of surface layer (nm) |
|---|---|---|---|
| Example 19 | 50 | 1 | 800 |
| Example 20 | 150 | 2 | |
| Example 21 | 260 | 3 | |
| Example 22 | 360 | 4 | |
| Example 23 | 460 | 5 | |
| Example 24 | 560 | 6 | |
| Example 25 | 660 | 7 | |

For each of the obtained electrophotographic photosensitive members, according to the same procedures as in Example 2, the initial electric potential properties were evaluated, and the sensitivity nonuniformity and the sensitivity variation width in the print durability test, the transcription state of the interference pattern and the greatest value of reflectance were evaluated.

In each of Examples 19 to 25, for the initial charging ability, the sensitivity and the residual electric potential, and the sensitivity nonuniformity and the sensitivity variation width in the course of the durability test, and the transcription of the interference pattern, the ratios of these quantities to those of Comparative Example 3 were derived and evaluated according to the following evaluation standards.

◎: Improved by 20% or more in relation to Comparative Example 3.

○: Improved by 10 to 20% in relation to Comparative Example 3.

Δ: Improved by 0 to 10% in relation to Comparative Example 3.

The evaluation results of these quantities, and the greatest value of reflectance in each of the experiments concerned are collectively shown in Table 15.

TABLE 15

| | Value of m in formula (2) | Charging ability | Sensitivity | Residual electric potential | Sensitivity nonuniformity | Sensitivity variation width | Transcription of interference patterns | Greatest value of reflectance (%) |
|---|---|---|---|---|---|---|---|---|
| Example 19 | 1 | ○ | ◎ | ◎ | ◎ | ◎ | ◎ | 5 |
| Example 20 | 2 | ○ | ◎ | ◎ | ◎ | ◎ | ◎ | 7 |
| Example 21 | 3 | ◎ | ◎ | ◎ | ◎ | ◎ | ◎ | 10 |
| Example 22 | 4 | ◎ | ◎ | ◎ | ○ | ◎ | ◎ | 14 |
| Example 23 | 5 | ◎ | ◎ | ◎ | ○ | ○ | ○ | 16 |
| Example 24 | 6 | ◎ | ◎ | ◎ | ○ | Δ | ○ | 21 |
| Example 25 | 7 | ◎ | ◎ | ◎ | ○ | Δ | ○ | 23 |

As can be seen from Table 15, in every Example, satisfactory initial electric potential properties could be obtained; by imparting antireflection capability to the intermediate layer, as compared to the case where the intermediate layer without antireflection capability was formed, the greatest value of reflectance could be reduced for the same optical thickness, namely, for the same m value, and simultaneously, the sensitivity nonuniformity and the transcription of the interference pattern could be alleviated; thus, within a range of m in formula (2) from 1 to 5, satisfactory results were obtained.

In each of Examples 2 to 26, by use of the laser light having a wavelength of 405 nm, the print durability test was carried out; even when the wavelengths from 600 to 800 nm, which have hitherto been used, were used, electrophotographic photosensitive members could be obtained in each of which the transcription of the interference pattern was satisfactorily slight and the sensitivity nonuniformity and the sensitivity variation width were small, by regulating the thickness of the intermediate layer so as for the greatest value of reflectance to be 20% or less, by regulating the thickness so as for the m value in formula (2) to fall within a range from 1 to 5, and moreover by regulating the refractive index of the intermediate layer so as for the intermediate layer to acquire antireflection capability.

The present application claims the priorities based on Japanese Patent Application No. 2004-074414 filed on Mar. 16, 2004, and Japanese Patent Application No. 2005-051085 filed on Feb. 25, 2005, which are hereby incorporated by reference herein.

What is claimed is:

1. An electrophotographic photosensitive member comprising on a conductive substrate at least a photoconductive layer composed mainly of amorphous silicon, a surface layer, and at least one intermediate layer interposed between said photoconductive layer and said surface layer, wherein:

said surface layer comprises a metal fluoride, exclusive of silicon fluoride; and said intermediate layer comprises a metal oxide selected from the group consisting of aluminum oxide, magnesium oxide, lanthanum oxide and titanium oxide, wherein when, by using a light scanning device in which the exposure laser light is made incident on a rotary polygonal mirror to deflect the laser light, said photoconductive layer is exposed to said exposure laser light while the incidence angle thereof is being varied, the thickness and refractive index of said intermediate layer is controlled so that the greatest value of reflectance, which varies as a function of the thickness variation of said surface layer and the incidence angle of said exposure laser light, may be 20% or less, wherein the thickness and refractive index of said intermediate layer are controlled so that phase difference Δφ (rad) between a component of said laser light, which is first reflected on the interface between said photoconductive layer and said intermediate layer and then reaches the interface between said intermediate layer and said surface layer, and another component of said laser light, which is reflected on the interface between said intermediate layer and said surface layer, satisfies the condition of the following formula (1):

$$\Delta\phi=\pi(2k-1) \quad (1)$$

where k represents an integer of 1 to 5.

2. The electrophotographic photosensitive member according to claim 1, wherein said intermediate layer and said surface layer are formed by sputtering.

3. The electrophotographic photosensitive member according to claim 1, wherein said metal fluoride is magnesium fluoride.

4. An electrophotographic photosensitive member comprising on a conductive substrate at least a photoconductive layer composed mainly of amorphous silicon, a surface layer, and at least one intermediate layer interposed between said photoconductive layer and said surface layer, wherein:

said surface layer comprises a metal fluoride, exclusive of silicon fluoride; and said intermediate layer comprises a metal oxide selected from the group consisting of aluminum oxide, magnesium oxide, lanthanum oxide and titanium oxide, wherein when, by using a light scanning device in which the exposure laser light is made incident on a rotary polygonal mirror to deflect the laser light, said photoconductive layer is exposed to said exposure laser light while the incidence angle thereof is being varied, the thickness and refractive index of said intermediate layer is controlled so that the greatest value of reflectance, which varies as a function of the thickness variation of said surface layer and the incidence angle of said exposure laser light, may be 20% or less, wherein said intermediate layer is composed of one layer, the refractive index n of said intermediate layer and the thickness d (nm) of said intermediate layer satisfy the conditions of the following formulas (2) and (3):

$$d=(\lambda/4n)\cdot(2m-1) \quad (2)$$

$$n_{SL}<n<n_{PCL} \quad (3)$$

where d represents the thickness (nm) of the intermediate layer, λ represents the wavelength (nm) of the exposure laser light, n represents the refractive index of the intermediate layer, m is an integer of 1 to 5, $n_{SL}$ represents the refractive index of the surface layer, and $n_{PCL}$ represents the refractive index of the photoconductive layer.

5. The electrophotographic photosensitive member according to claim 4, wherein a value of the refractive index of said intermediate layer satisfies the condition of the following formula (4):

$$n^2=n_{PCL}\cdot n_{SL} \quad (4)$$

where n, $n_{PCL}$ and $n_{SL}$ represent the refractive indices of the intermediate, photoconductive and surface layers, respectively.

6. The electrophotographic photosensitive member according to claim 4, wherein said intermediate layer and said surface layer are formed by sputtering.

7. The electrophotographic photosensitive member according to claim 4, wherein said metal fluoride is magnesium fluoride.

* * * * *